US005176012A

United States Patent [19]

Oh et al.

[11] Patent Number: 5,176,012

[45] Date of Patent: Jan. 5, 1993

[54] PRESSURE AND ROTARY TYPE WASHING MACHINE AND A WASHING METHOD BY USING SUCH

[75] Inventors: Dong Y. Oh; Jae C. Rew, both of Seoul; Kwan R. Park, Busan; In Cheol Jung, Seoul, all of Rep. of Korea

[73] Assignee: Gold Star Co., Ltd., Rep. of Korea

[21] Appl. No.: 728,099

[22] Filed: Jul. 10, 1991

[30] Foreign Application Priority Data

| | | | |
|---|---|---|---|
| Dec. 4, 1990 | [KR] | Rep. of Korea | 19865/1990 |
| Dec. 19, 1990 | [KR] | Rep. of Korea | 21062/1990 |
| Dec. 26, 1990 | [KR] | Rep. of Korea | 21793/1990 |
| Dec. 31, 1990 | [KR] | Rep. of Korea | 23065/1990 |

[51] Int. Cl.[5] ..... D06F 21/14

[52] U.S. Cl. ..... 68/21; 68/23.2; 68/31; 68/134

[58] Field of Search ..... 134/37, 32, 33, 34, 134/86, 21, 22 R, 23.2, 134, 89, 31

[56] References Cited

U.S. PATENT DOCUMENTS

| | | | |
|---|---|---|---|
| 1,213,704 | 1/1917 | Stensrud | 68/34 |
| 1,261,545 | 4/1918 | Johnson | 68/34 X |
| 1,745,177 | 1/1930 | Markley | 68/134 |
| 2,147,303 | 2/1939 | Lang | 68/21 |
| 2,475,029 | 7/1949 | Kahn | 68/23.2 X |
| 2,534,467 | 12/1950 | McFarland | 68/122 |
| 2,593,292 | 4/1952 | Gaugler | 68/21 |
| 2,598,057 | 5/1952 | Horvath | 68/21 X |
| 2,655,803 | 10/1953 | Richardson | 68/21 X |
| 2,658,371 | 11/1953 | Bowman | 68/21 |
| 2,666,316 | 1/1954 | Candor | 68/21 |
| 2,824,438 | 2/1958 | Candor | 68/21 |
| 4,044,626 | 8/1977 | Hayashi et al. | 68/23.2 X |
| 4,102,156 | 7/1978 | James | 68/134 Y |
| 4,149,393 | 4/1979 | Uhlyarik | 68/21 |

FOREIGN PATENT DOCUMENTS

| | | | |
|---|---|---|---|
| 067237 | 4/1965 | Belgium . | |
| 0532174 | 12/1929 | Fed. Rep. of Germany . | |
| 905130 | 1/1954 | Fed. Rep. of Germany | 68/134 |
| 1119476 | 2/1955 | France . | |
| 212640 | 7/1984 | United Kingdom . | |

*Primary Examiner*—Frankie L. Stinson

*Attorney, Agent, or Firm*—Ostrolenk, Faber, Gerb & Soffen

[57] ABSTRACT

A pressure and rotary type washing machine and a washing method by using such. The pressure and rotary type washing machine comprises: an agitating member rotatably mounted at a bottom of the washing tube and provided with at least one roller, a pressure member mounted movable upward and downward at an upper portion inside said washing tub and adapted for providing pressure for laundry articles, a rotation driving mechanism adapted for selectively driving the washing tube or the agitating member, and a pressure member driving mechanism adapted for driving the pressure member to move between a rest position and a washing position. The washing method comprises the steps of: positioning the laundry articles between the pressure member and the agitating member inside the washing tub; and driving the agitating member to rotate so that simultaneously with being agitated the laundry articles may be washed by gentle hand washing, beating and scrubbing washing operation. The present invention can provide a good washing effect for the laundry articles, the washing effect resulting from a composite washing operation comprising gentle hand washing, beating and scrubbing washing operations.

25 Claims, 16 Drawing Sheets

PRESSURE AND ROTARY TYPE WASHING MACHINE AND A WASHING METHOD BY USING SUCH

BACKGROUND OF THE INVENTION

The present invention relates to a pressure and rotary type washing machine and a washing method by using such, and more particularly to a pressure and rotary type washing machine and a washing method by using such, in which the laundry articles are washed by a composite washing operation comprising a gentle hand washing, a beating, a scrubbing, and a rolling and rotating actions provided by an agitation by forward and reversed directional rotation of an agitator, a pressing by a pressure member movably provided upwards and downwards inside the dehydrating and washing tub, and also folding and rolling by rollers rotatably mounted at the agitating member.

Generally, a known automatic washing machine has relatively simple arrangement provided with an outer cabinet, an imperforate tub mounted inside said outer cabinet, a perforated dehydrating and washing tub (hereinafter referred to simply as the washing tub) mounted inside said imperforate tub and adapted to wash the laundry articles and dehydrate the washed laundry articles, an agitating vane wheel (pulsator) disposed in the bottom of said washing tub and a drive motor disposed below the bottom wall of said imperforate tub and adapted for selectively driving said agitating vane wheel and said washing tub.

In addition, the known automatic washing machine schematically comprises a washing part for practically executing the washing action by directly applying the washing power, such as frictional power, to the laundry articles being washed, a driving part for driving said washing part and a supporting part for supporting said washing and driving parts.

In the general operation of the washing machine of the above arrangement, the driving motor rotates so as to drive the agitating vane wheel in order to circulate the washing water, thereby causing the laundry articles to rotate accompanied with the circulating water flow in order to be washed.

However, the known washing machine adopts a washing method in which the laundry articles are, during simple rotation thereof in accompaniment with the circulating water flow, washed by frictional powers generated respectively between the laundry articles and the agitating vane wheel, between the laundry articles and the inner surface of the washing tub, and among the laundry articles themselves so that the gentle hand washing and beating action may be not sufficient to completely wash clothes having partially heavy dirt. Furthermore, there are drawbacks that the circulation of the laundry is so deficient that the laundry articles may not be washed sufficiently except for parts contacting with the agitating vane wheel, and additionally, there is an excessive spending of the washing water.

The inventors of the present application have, therefore, studied for a few years in order to provide a washing machine having a washability which is so ameliorated that the above-mentioned drawbacks can be solved.

Especially, the inventors have concentrated more in study of the washing part, which directly executes the washing operation than another parts of the washing machine as above-mentioned, so as to make said washing part provide a good washing effect as if the laundry articles were washed by the human hands.

There has been, therefore, proposed another type of known washing machine capable of improving the washability in efforts of providing a washing machine having an improved washing part. This type of washing machine is generally called a pressure and rotary type of washing machine. Generally, almost of these types of washing machines proposed by the inventors, each is provided with a washing tub newly including a pressure member adapted for applying a pressure to the laundry articles and rollers adapted to apply a rolling action to the laundry articles so as to provide a composite washing operation comprising a gently hand washing, a beating, and also a rolling and rotating action for the laundry articles, thereby improving the washability considerably. In addition, the proposed washing machines have been proposed as several types in accordance with the change of the arrangement of the pressure member and the rollers, and also the variations of the driving style.

One example of the above mentioned pressure and rotary type washing machines capable of improving the washability is disclosed in Korean Patent Application No. 89-9042 filed in the name of the same assignee of this application on Jun. 29, 1989 and published on Jan. 30, 1991. as Korean Laid Open Patent Publication No. 91-1147. This patent application discloses a washing machine and a washing method capable of mechanically executing a composite washing operation so as to reduce the clothes damage and the amount used of the washing water, and make it possible to wash the relatively large quantity of laundry articles and also provide a good washing effect as if the laundry articles were washed by the human hands.

As shown in FIG. 1, the above pressure and rotary type washing machine executing a composite washing operation comprising a pressure stroke when the pressure member is reciprocated in relation to the laundry articles laid on the bottom of the washing tub in order to press said laundry articles, and an agitation stroke when the washing tub rotates in order to agitate the laundry articles therein. This washing machine is provided with a washing tub section 101 including a pressure member comprising a circular pressure plunger 102 and rollers 103 rotatably mounted to said plunger 102, a link mechanism 104 adapted for reciprocating said pressure member, a link driving member 112 adapted for extending and retracting said link mechanism 104, a rotary spacer 111 and a driving screw 114 rotatably connected with said link driving member 112 and adapted for transmitting the rotation power from a link driving motor 109 which is also connected to said spacer 111 and adapted for providing said rotation power and a pressure absorber 105, and a washing tub driving section including a clutch 106, belt pulleys 107, a belt 107' connecting said belt pulleys 107 and a tub driving motor 108 adapted to rotate said washing tub 101, respectively.

In operation, the above-mentioned pressure and rotary type washing machine executes the composite washing operation comprising the following washing operations. First, as shown in FIG. 2A, simultaneously with the agitation of the washing tub 101 the reciprocation of the pressure plunger 102 occurs so that the laundry articles may be subject to the vortex flow of the washing water generated from said agitation of the washing tub 101, the frictional power and the wringing power by the rollers 103 generated from said reciprocation of the pressure plunger 102. Second, as shown in FIGS. 2B and 2C, the pressure plunger 102 descends toward the laundry articles during the forward directional rotation of the washing tub 101, on the contrary, ascends during the reversed directional rotation of the washing tub 101 so that the laundry articles are first washed by the fictional power and periodically wringing power provided by the rollers 107, and thereafter, turned over in order to be second washed by the same manner. Third, as shown in FIGS. 2D and 2E, the pressure plunger 102 stops the reciprocation during the agitation of the washing tub 101, on the contrary, the pressure plunger 102 is repeatedly reciprocated upwards and downwards during the temporary rest of the washing tub 101 so that the laundry articles can be washed. Fourth, as shown in FIG. 2F, the pressure plunger 102 is continuously reciprocated while the washing tub 101 continues stopping so that the laundry articles can be washed, thereby prevented from the occurrence of the crease, which may often happen in a wool washing process. Thereafter, the washed laundry articles are subject to the dehydration process in the washing tub 101.

Additionally, there has been proposed another known washing machine having an improved link driving member as disclosed in Korean Utility Model Application No. 89-16911 filed on Nov. 15, 1989.

As shown in FIGS. 3 and 4, this washing machine comprises a pressure plunger 102 disposed inside the washing tub 101, a link mechanism 104 mounted between the base plate 115*a* under the cover 115 and the said pressure plunger 102, a spur gear 116 having at the center thereof a threaded rod 116*a* downwardly and integrally formed therewith and engaging with the link driving gear 117 of the link driving motor 109, a threaded guide member 119 engaging with the threaded rod 116*a* downwardly penetrating the base plate 115*a*, and having a connecting pin 119*a* which is inserted into a connecting hole formed at the upper portion of the link mechanism 104 in order to provide a connection therebetween, a sliding guide member 118 mounted on the pressure plunger 102 and connected with the lower portion of the link member 104 by means of a connecting pin 118*a*. Thus in this type of washing machine, the link mechanism 104 can be extended or retracted in response to the rotational direction of the spur gear 116.

In the drawings, the reference numerals 120, 121 and 122 denote a guide rods for guiding the threaded guide member 119 fixed to the base plate 115, a sliding guide member guiding rod fixed onto the pressure plunger 102 and a radial bearing for supporting the rotation of the spur gear 116, respectively.

In operation of the above washing machine, the link driving gear 117 connected to the link driving motor 109 rotates forwardly so as to rotate the spur gear 116 in the reversed direction, thereby causing the threaded guide member 119 connected to the threaded rod 116*a* of the spur gear 116 to move downwardly under guiding of the threaded guide member guiding rods 120 fixed to the base plate 115*a*. Thus, the link mechanism 104 connected to the threaded guide member 119 by means of the connecting pin 119*a* will be retracted. Therefore, the pressure plunger 102 ascends in accordance with the retraction of the link mechanism 104. At this time, the sliding guide member 118 can simply slide along the sliding guide member guiding rod 121 fixed to the pressure plunger 102.

On the contrary, the pressure plunger 102 will be descended in response to the reversed directional rotation of the link driving gear 117 so that the laundry articles will be subject to the composite washing operation provided by the pressure plunger and the agitating member. Thus, the above-mentioned washing machine can improve the washability for the laundry articles by the reciprocation of the pressure plunger 102 in response to the forward and reversed directional rotation of the link driving motor 109.

It has been known that the above-mentioned pressure and rotary types of washing machines could increase the washing effect. However, there has been disadvantage that the circulation of the washing water was not sufficient to completely wash the laundry articles. Furthermore, the washing machines have another disadvantage that there must be necessary a considerably high pressure over a predetermined pressure (over about 50 Kgf) in order to improve the washing effect because of the rollers mounted to the pressure plunger, thus the supporting structure for supporting the pressure plunger must have a relatively high strength and the output of the link driving motor must be considerably increased. In addition, there is another disadvantage that a part of the laundry articles near the bottom of the washing tub may be deficiently washed, while another part of the laundry articles near the pressure plunger may be sufficiently washed as a result of the circulation of the washing water.

In an effort of solving the above-mentioned disadvantages of the pressure and rotary type washing machine, the application of the present invention proposed another pressure and rotary type washing machine and a method for controlling such as disclosed in Korean Patent Application No. 90-3711 filed on Mar. 20, 1990.

As shown in FIG. 5, this pressure and rotary type of washing machine comprises the similar elements to the previously proposed and above-mentioned pressure and rotary type washing machines except for newly including pressure absorbers 105 each provided under the pressure plunger 102 capable of being reciprocated by the link mechanism 104 and having an outlet port for a detergent, rollers 103 rotatably mounted to the rotary vane 123 disposed at the bottom of a fixed type washing bath 110.

This washing machine washes the laundry articles by a composite washing operation comprising a pressure stroke operation and an agitation stroke operation, said pressure stroke operation in which the upper dead point of the pressure plunger 102 is previously controlled to be located at a 1.2 times higher position than a height occupied by the hydrated laundry articles in the washing water before the reciprocation of the pressure plunger 102 and said agitation stroke operation comprising a rotation of the rotary vane provided with the rollers 103 in order to agitate the laundry articles 123.

In operation of the above washing machine, the rollers 103 of the rotary vane 123 rotate according to the rotation of the rotary vane 123 so as to generate a frictional power between the rolling rollers 103 and the laundry articles disposed between the pressure plunger 102 and the rotary vane 123, which frictional power make the laundry articles be forced to rotate. However, the pressure plunger 102 is fixed at the above-mentioned predetermined position so that the laundry articles may be lumped together and also the rollers 103 of the rotary vane 123 can function as if they were protrusions, thereby causing the rollers 103 to apply a pressing and scrubbing action to the laundry articles. Also, irrespective of occurrence of the over friction between the rollers 103 and the laundry articles, the rollers 103 do not give any damage, which damage may be happened by the excessive friction or over pressure, to the laundry articles because they are mounted to the rotary vane 123 so as to freely rotate with respect to the rotary vane 123.

In addition, the laundry articles spirally rolls under the pressure plunger 102 as a result of the friction generated by the pressure plunger 102 so that the laundry articles can smoothly and continuously circulate with the washing water inside the fixed washing bath 110, thereby providing advantages of an equal washing effect and an improved washability simultaneously with solving the above described disadvantages encountered in the previously proposed washing machines.

Furthermore, this type of washing machine allows the washing water to be supplied in order to be contained inside the washing bath 110 by a random height between two heights occupied by the lower surface of the pressure plunger 102 and the hydrated laundry articles in the washing water, respectively, so that the washing bath ratio can be reduced to about 10:1 in weight of the washing water:volume of the laundry articles, which washing bath ratio is so economical washing bath ratio that the amount used of washing water can be reduced to a degree of $\frac{1}{3}$ on the basis of the generally demanded ratio over about 30:1.

However, this type of washing machine adopts a lagy tongs mechanism in which the pressure plunger 102 is downwardly hanged to the upper portion inside the washing bath 110 so that there may be happened a swinging during the movement of the pressure plunger 102 and the connecting portions of the link mechanism may be possible to be broken down for long time usage. Furthermore, there has been a disadvantage of increasing the volume of the washing machine so that it may be not easy to treat the washing machine, which disadvantage is known to us not to be solved with having the basic structure.

There has been, therefore, proposed another pressure and rotary type washing machine of which a driving mechanism for driving the pressure plunger is so developed that the pressure plunger can be stably and directly reciprocated along the washing tub as disclosed in Korean Utility Model Application No. 89-16906 filed by this applicant on Nov. 15, 1989.

As shown in FIGS. 6 and 7, this type of washing machine is provided with a pair of racks 202 vertically mounted at both sides of the washing bath 201, a pair of pinions 203 rotatably mounted at diametrically spaced ends of the circular pressure plunger 204, respectively, which plunger 204 has a relatively smaller diameter than the inner diameter of the washing tub 201, a pinion drive reversible motor 205 and a wire pulley 208 enclosed inside the pressure plunger 204 and adapted for driving said pinion 203 and winding a wire cable 207 round said pulley 208, respectively, said wire connected to the cover 206 at a free end thereof. Also enclosed inside the pressure plunger 204 between the pinion drive motor 205 and a pinion 203 are an anti-rotation stopper 209 and a magnetic first stopper 210 each adapted for preventing the pressure plunger 204 from rotating centering around the pinion drive shaft of the drive motor 205. This washing machine is additionally provided with a second magnetic stopper 212 mounted at the upper portion of the outer imperforated tub 211 and adapted for rearranging the racks 202 with respect to the pinions 203 after dehydrating process, and also a limit switch 213 and a circular depression 214 each provided inside the cover 206.

In operation of the above-mentioned washing machine, the pulley 208 rotates forward and reversed direction according to the rotation of the reversible drive motor 205 so that the pressure plunger 204 suspended by the tension power of the wire 207 being wound on and unraveled from the pulley 208 may be reciprocated upward and downward inside the washing tub 201, thereby making the laundry articles be subject to the pressure of the plunger 204.

Therefore, this type of washing machine provides the pressure plunger 204 which can be stably reciprocated inside the washing tub 201 without any swinging so that the pressing effect can be considerably increased as compared to the previously mentioned washing machine having a link mechanism. Furthermore, this washing machine has so compact that most of driving elements can be enclosed inside the pressure plunger 204 instead of being separately installed at the outside of the washing tub.

However, there has been known that the above-mentioned several types of pressure and rotary type washing machines had several drawbacks of complicate driving structure for driving the pressure plunger because of the necessity of the continuous reciprocation of the pressure plunger during the washing process, and overload loaded to the driving mechanism as a result of continuous reciprocation of the pressure plunger, increasing the amount used of electric power and generation of severe noise.

SUMMARY OF THE INVENTION

It is, therefore, an object of the present invention to provide a pressure and rotary type washing machine and a washing method by using such, which are capable of solving the above-mentioned disadvantages by comprising a pressure member controlled to be fixedly located at an optimum position inside the washing and dehydrating tub (hereinafter referred to simply as the washing tub) according to the quantity of the laundry articles and an agitating member installed at the bottom of the washing tub and having a plurality of rollers so that the laundry articles laid between the pressure member and the agitating member can be subject to the composite washing operation comprising the beating, the gentle hand washing and scrubbing simultaneously with the agitating by the agitating member, thereby making it possible to wash the laundry articles as if they were washed by the human hands.

It is other object of the present invention to provide a pressure and rotary type washing machine and a washing method by using such, which can use the rotation power of a washing tub driving motor in driving the pressure member to be smoothly reciprocated upwards and downwards, thereby providing an efficient and economical washing machine.

In one aspect, the present invention provides a pressure and rotary type washing machine having an imperforate outer tub and a perforated washing tub, said washing machine comprising: an agitating member rotatably mounted at a bottom of said washing tub and provided with at least one roller; a pressure member mounted movably upward and downward at an upper portion inside said washing tub and adapted for providing pressure for laundry articles; a rotation driving mechanism adapted for selectively driving said washing tub or said agitating member; and a pressure member driving mechanism adapted for driving said pressure member to move between a rest position and a washing position.

In another aspect, the present invention provides a washing method by using a pressure and rotary type washing machine comprising a washing tub, a pressure member adapted for applying a pressure to laundry articles and an agitating member adapted for agitating the laundry articles and having a plurality of rollers, the method comprising the steps of: positioning said laundry articles between said pressure member and said agitating member inside the washing tub; driving said pressure member to move from a rest position to a washing position corresponding to the quantity of the laundry articles before driving said agitating member; forming a closed washing space provided said pressure member, said agitating means and inner walls of said washing tub in order to limit an acting space of said washing water and said laundry articles; and driving said agitating member to rotate so that simultaneously with being agitated said laundry articles may be washed by gentle hand washing, beating and scrubbing washing operations.

BRIEF DESCRIPTION OF THE DRAWINGS

The above and other objects, features and other advantages of the present invention will be more clearly understood from the following detailed description taken in conjunction with the accompanying drawings, in which:

FIGS. 1 to 7 are views showing several embodiments of known pressure and rotary type washing machines proposed by the inventors of this application, in which:

FIG. 1 is an elevational sectional view of an embodiment of a known pressure and rotary type washing machine;

FIG. 3 is an elevational sectional view of a pressure driving section of another embodiment of a known pressure and rotary type washing machine;

FIG. 4 is a sectional view taken along the line A—A of FIG. 3;

FIG. 5 is an elevational sectional view of still another embodiment of a known pressure and rotary type washing machine;

FIG. 6 is an elevational sectional view of still another embodiment of a known pressure and rotary type washing machine; and FIG. 7 is an enlarged plane view of the essential parts of the washing machine of FIG. 6;

FIGS. 9 to 12 are views showing an embodiment of a pressure and rotary type washing machine in accordance with the present invention, in which:

FIG. 9 is an elevational sectional view;

FIG. 10 is an enlarged and broken perspective view;

FIG. 11 is a control block diagram of the washing machine of FIG. 9.

FIGS. 17 to 20 are views showing still another embodiment of a pressure and rotary type washing machine in accordance with the present invention, in which:

FIG. 17 is an elevational sectional view;

FIG. 18 is a schematic plane view showing another embodiment of a pressure member;

FIG. 19 is an elevational sectional view of FIG. 18; and

FIG. 20 is an enlarged sectional view taken along the line B—B of FIG. 18;

FIGS. 21 to 23 are views showing still another embodiment of a pressure and rotary type washing machine in accordance with the present invention, in which:

FIG. 21 is an elevational sectional view;

FIG. 22 is a schematic plane view showing another embodiment of a pressure member; and FIG. 23 is a rear view of the pressure plunger of FIG. 22.

DETAILED DESCRIPTION OF THE PREFERRED EMBODIMENTS

Figure 1:
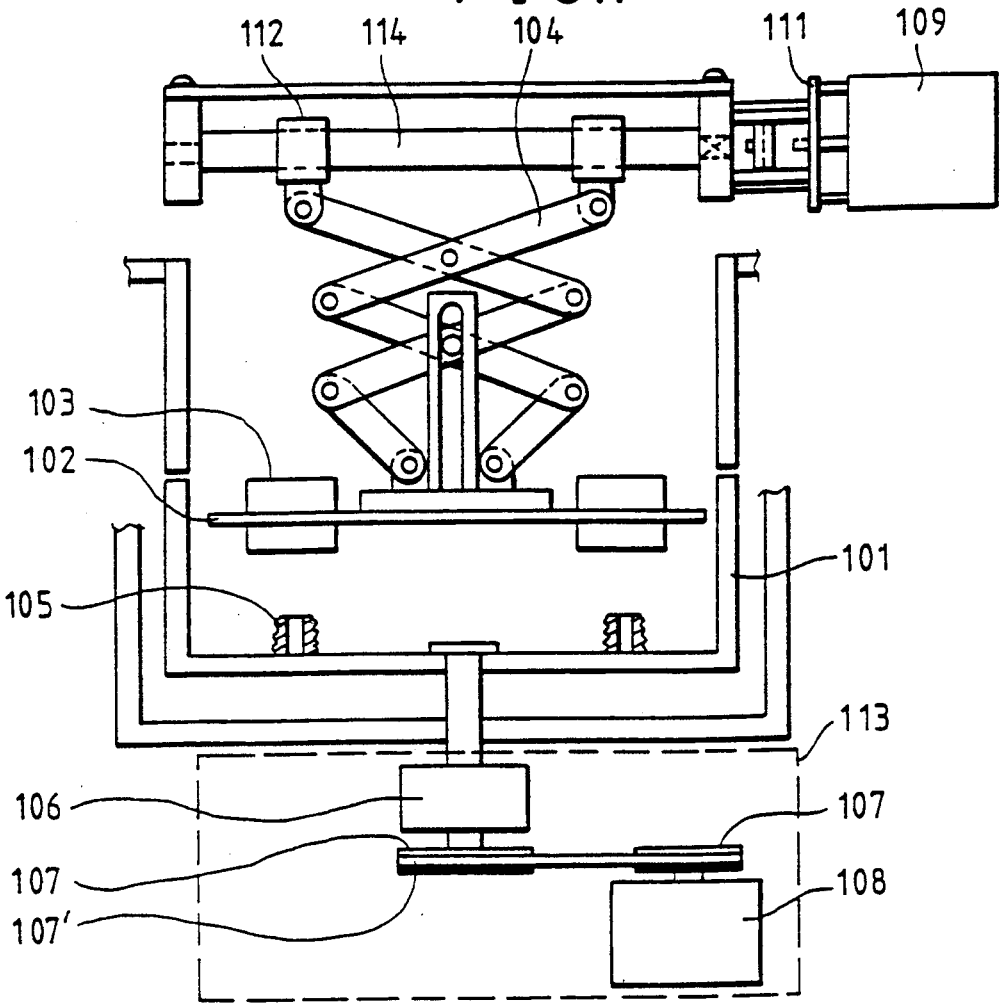
Figure 2A:
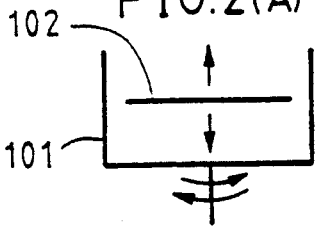
FIGS. 2A to 2F are schematic views representing the washing methods by the washing machine of FIG. 1.
Figure 2B:
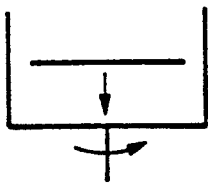
Figure 2C:
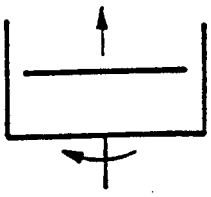
Figure 2D:
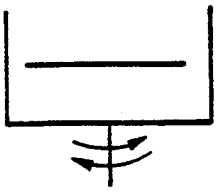
Figure 2E:
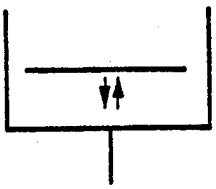
Figure 2F:
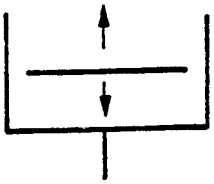
Figure 3:
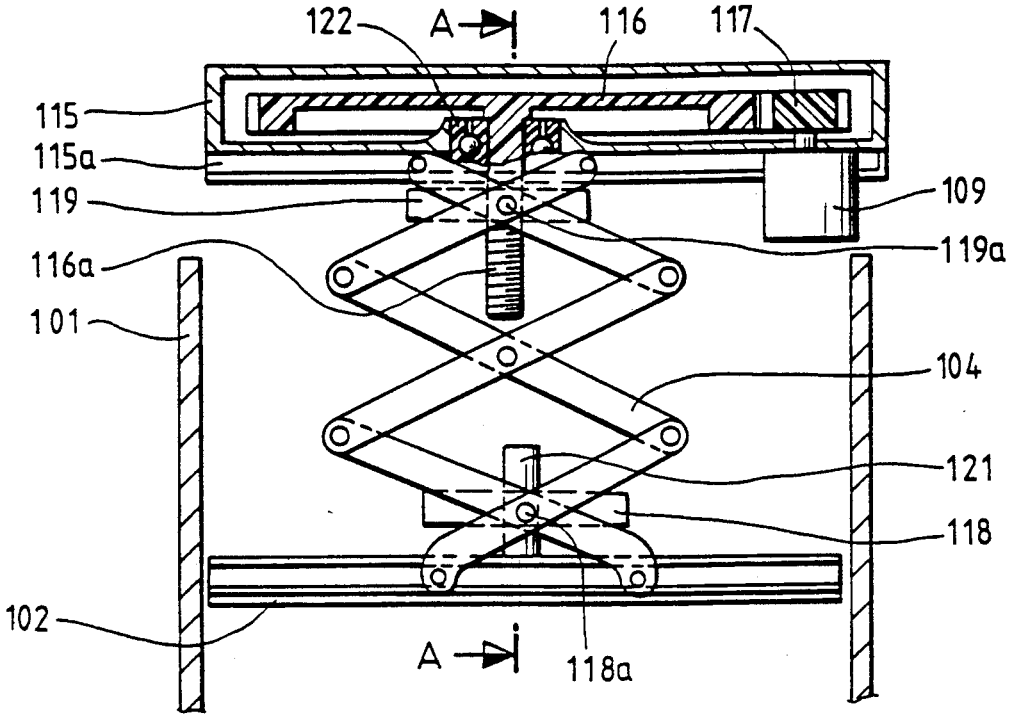
Figure 4:
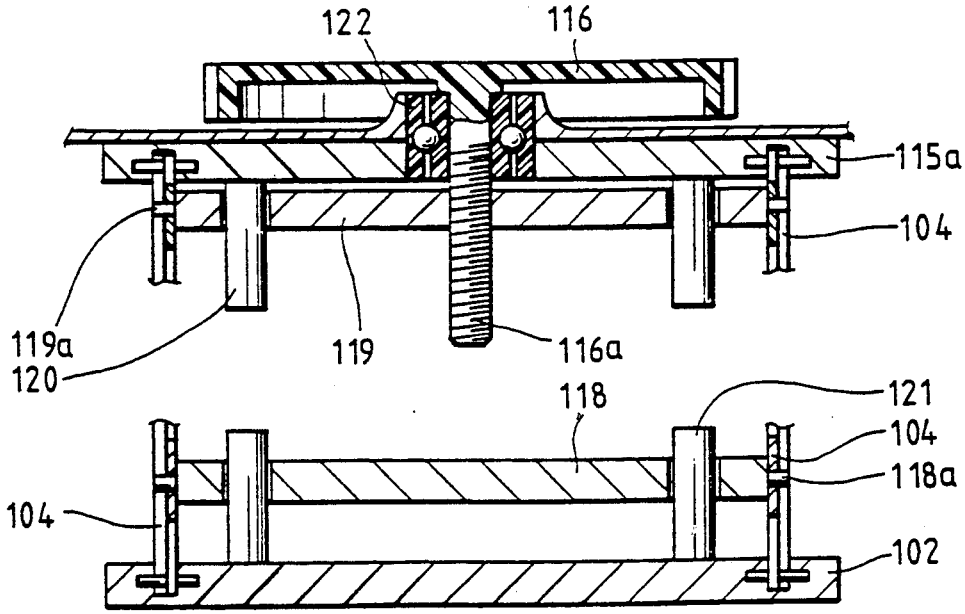
Figure 5:
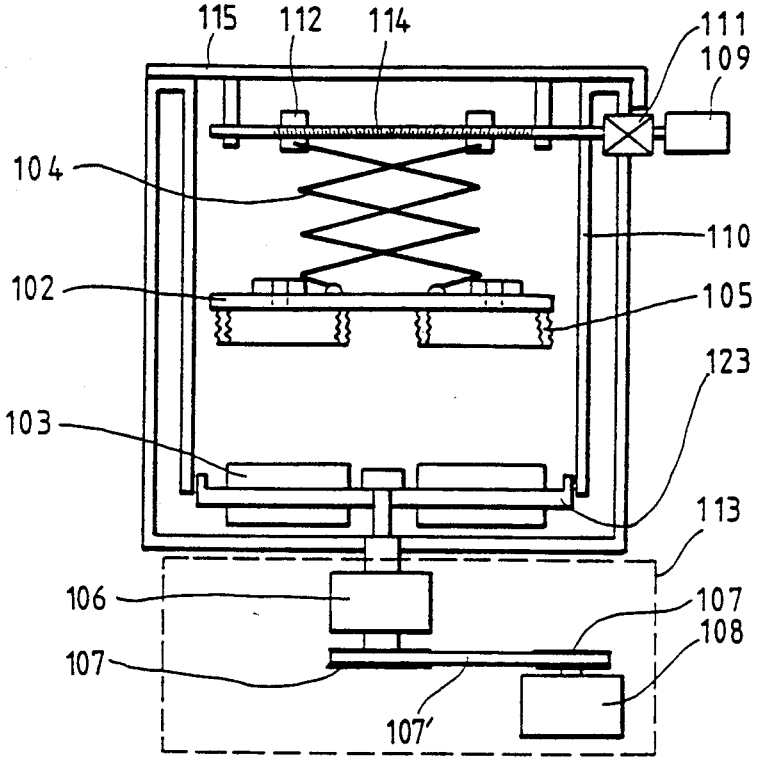
Figure 6:
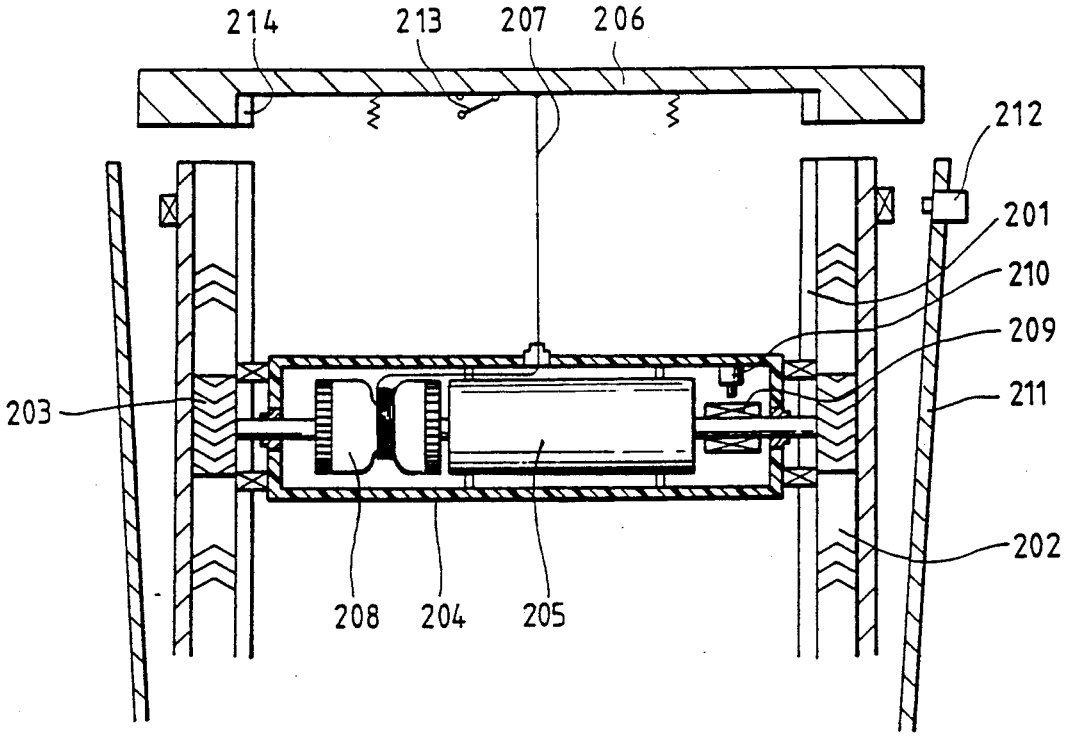
Figure 7:
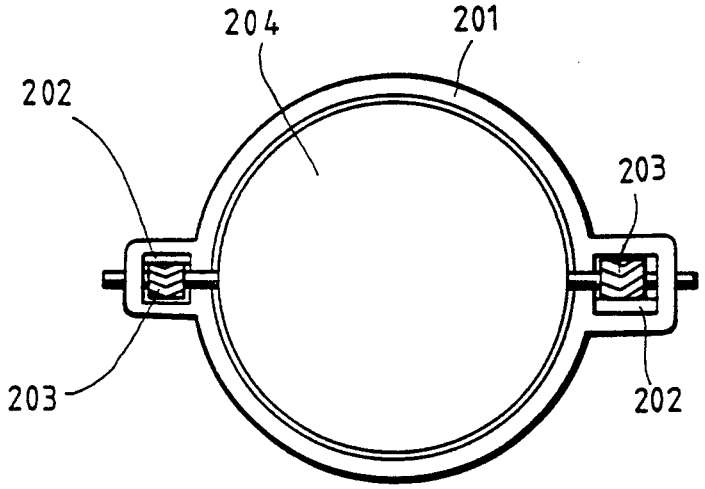
Figure 8:
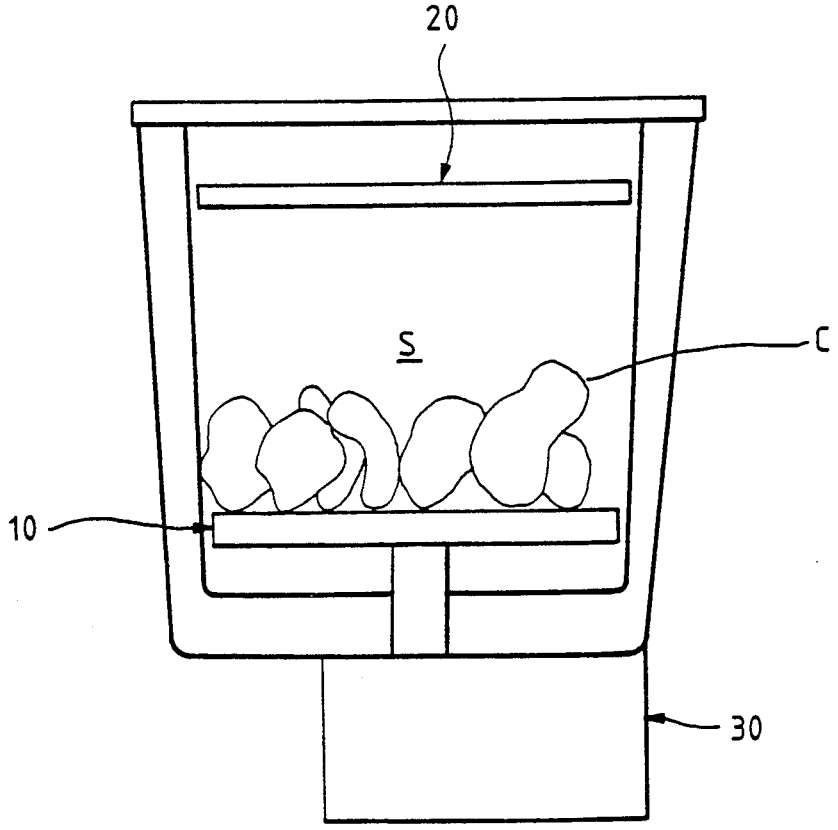
FIG. 8 is an elevational sectional view representing a pressure and rotary type washing method in accordance with the present invention.

First, the washing method in accordance with the present invention will be generally described in conjunction with FIG. 8 which is an elevational sectional view representing a pressure and rotary type washing method in accordance with the present invention.

As shown in FIG. 8, the washing method according to this invention comprises a washing operation in which the laundry articles C located between a pressure member 20 and an agitating member 10 are washed by the rotation power provided by the agitating member 10.

The pressure member 20 is adapted for applying a pressure to the laundry articles C, therefore, installed at a position upper the agitating member 10 inside a washing tub 1 so as to be reciprocated upwards and downwards between a washing position and a rest position. In addition, the location of the washing position can be easily controlled to be varied in accordance with the quantity of the laundry articles C in order to contact with the upper portion of the laundry articles irrespective of the quantity of the laundry articles C.

Therefore, upon powering on after locating the laundry articles C on the agitating member 10 inside the washing tub 1 and then driving the pressure member 20 to move downwards in order to contact with the laundry articles C, the agitating member 10 rotates so as to provide a composite washing operation comprising a gentle hand washing, a beating and a scrubbing for the circulating laundry articles accompanying with the circulation of the washing water.

In addition, size and style of the pressure member 20 can be randomly varied as occasion demands. For an embodiment, a pressure member having a size so as to close the upper portion of the washing tub 1 can be provided with an optimal washing space S among the inner surface of the washing tub 1, the pressure member 20 and the agitating member 10, which washing space S can be easily varied in accordance with the quantity of the laundry articles C, and limit the circulating extent of the laundry articles therewithin, and furthermore, be controlled by the upward and downward displacement of the pressure member 20 in order to vary its volume in accordance with the quantity of the laundry articles.

Hence, the washing method provided by the present invention can considerably increase the washability as the laundry articles can contact with random portion of the inner surface of the washing space S as a result of the capability of varying the washing space in correspondence with the quantity of the laundry articles C.

The agitating member 10 may include at least one roller so as to provide a rolling action for the laundry articles C, thereby make it possible to wash the laundry articles C by a composite washing operation comprising a gentle hand washing, a beating, a scrubbing and also a rotating simultaneous with rolling.

The above-mentioned washing method in accordance with the present invention can, therefore, provide the composite washing operation including all of the washing operations which have been provided by the traditional hand washing method and the known automatic washing machines.

Figure 9:
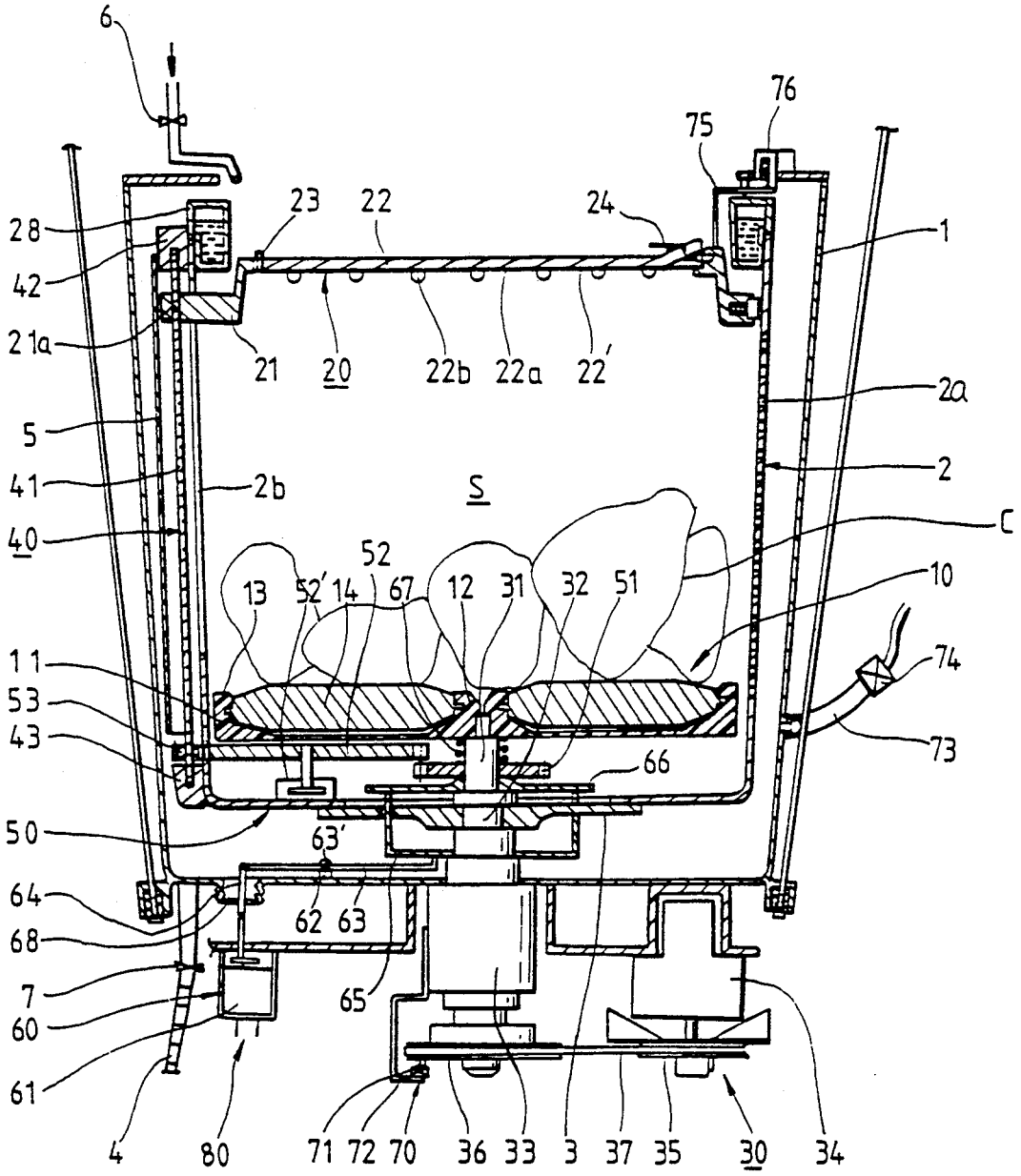

Turning next to FIGS. 9 to 12 which is an elevational sectional view of an embodiment of a pressure and rotary type washing machine in accordance with the present invention, an enlarged and broken perspective view of FIG. 9, a control block diagram of the washing machine of FIG. 9 and continuous flow diagrams of operations performed by a microcomputer of the washing machine of FIG. 9, respectively. the pressure and rotary type washing machine comprises an outer imperforate tub 1, a perforated washing and dehydrating tub 2 (hereinafter referred to simply as the washing tub) rotatably mounted inside said outer tub 1 and provided with perforations 2*a* at walls thereof, an agitating member 10 rotatably mounted at the bottom of said washing tub 2, a pressure member 20 mounted at an upper portion of the perforated washing tub 2 so as to move upwards and downwards, a driving mechanism 30 for driving said agitating member 10 and the washing tub 2 to rotate and a pressure member driving mechanism 40 for driving said pressure member 20 to be reciprocated upwards and downwards.

The agitating member 10 comprises a circular rotary 11 having a center portion 12, a circumferencial flange 13, an annular depression formed between said center portion 12 and said flange 13 and a plurality of rollers 14 provided in the depression and spaced apart from one another. Also, the pressure member 20 comprises an annular guide portion 21 and a pressure plate 22 of which one end is hinged to the guide portion 21 in order to be opened and closed as demands and the other end diametrically opposed to the one end is provided with a locking device 24.

The driving mechanism 30 comprises a clutch 33 installed under the bottom center of the outer tub 1 and provided with a washing shaft 31 and a dehydrating shaft 32, a driving motor 34 fixed to outer tub 1 near said clutch 33, which driving motor 34 is connected with the clutch 33 by connecting a motor pulley 35 and a clutch pulley 36 by means of a belt 37. The washing shaft 31 is connected to the center portion 12 of the circular rotary 11 and the dehydrating shaft 32 engages with a radially extending reinforcement 3 fixed to the under surface of the bottom of the washing tub 2 so that the rotation of the driving motor 34 can selectively drive the washing shaft 31 or the dehydrating shaft 32, thereby selectively driving the agitating member 10 or the washing tub 2 to rotate.

The pressure member driving mechanism 40 comprises a feed screw 41 which is vertically installed at a side of the washing tub 2 and having top and lower ends engaging with upper and lower bearings 42 and 43, respectively, and an upper portion engaging, in the screw type, with an end of the annular guide portion 21 of the pressure member 20. There is provided, in the pressure member driving mechanism 40, a feed screw driving device 80 adapted for driving the feed screw 41. In addition, the pressure driving member 80 is provided with a power transmission device 50 for driving the pressure member 20 by using the rotation power of the driving motor 34.

The power transmission device 50 comprises a driven gear 53 fixedly mounted to the lower end of the feed screw 41, a middle gear 52 engaging with the driven gear 53 mounted to a middle bearing portion 52' provided on the bottom of the outer imperforated tub 1, and also a driving gear 51 fixedly mounted to the washing shaft 31 of the clutch 33 so as to move upward and downward by a lifting device 60 and selectively engaging with the middle gear 52.

The lifting device 60 comprises a solenoid 61 fixed under the outer tub 1, a driving lever 63 disposed on the supporting portion 62 of the outer tub 1 by means of a lever shaft 63', a connecting lever 64 for connecting the driving lever 63 and a plunger of the solenoid 61, a power transmission 65 movably mounted to the dehydrating shaft 32 so as to move upward and downward and cooperating with the driving lever 63, a spacer 66 movably mounted to the washing shaft 31 between said driving gear 51 and said power transmission 65 so as to be lifted by said power transmission 65 in order to bias said driving gear 51 upwardly as demands, and an elastic body 67 for elastically supporting said driving gear 51, said spacer 66 and said power transmission 65.

The connecting lever 64 is provided with a bellows 68 for waterproof. Also, the elastic body 67 may comprise a compression spring.

There is also provided an auto-balancer 28 mounted at the upper portion of the washing tub 2 and adapted for balancing said washing tub 2 during the dehydration.

On the other hand, this washing machine is provided with a fabric quantity sensor 70 equipped under the clutch 33 and adapted for sensing the fabric quantity, a water level sensor 74 disposed at a washing water supplying pipe 73 extending outwardly from the relatively lower portion of the outer tub 1, and also a limit switch 76 mounted to a limit switch support 75 provided at the upper edge of the outer tub 1 and adapted for checking the rising limit of the annular guide portion 21.

The fabric quantity sensor 70 comprises a permanent magnet 71 fixedly secured under the clutch pulley 36 and a coil 72 closely disposed under said magnet 71 so that the sensor 70 can sense the quantity of the laundry articles C by counting the number of rotations of the driving motor 34 by checking the induced voltage by electromagnetic force generating as said permanent magnet 71 intermittently go past by the coil 72 during the rotation of the clutch pulley 36. If the quantity of the laundry articles, in other words the fabric quantity, is relatively small, the agitating member 10 can rotate more easily so that the generated frequency in the same time may increase than that of the relatively large quantity of the laundry articles. Thus, the fabric quantity sensor 70 can sense the fabric quantity by counting the number of the zero crossings of the voltage, which zero crossing represents a moment that the voltage is zero, induced by the electromagnetic force generating for a predetermined time while the motor is turned on.

Figure 10:
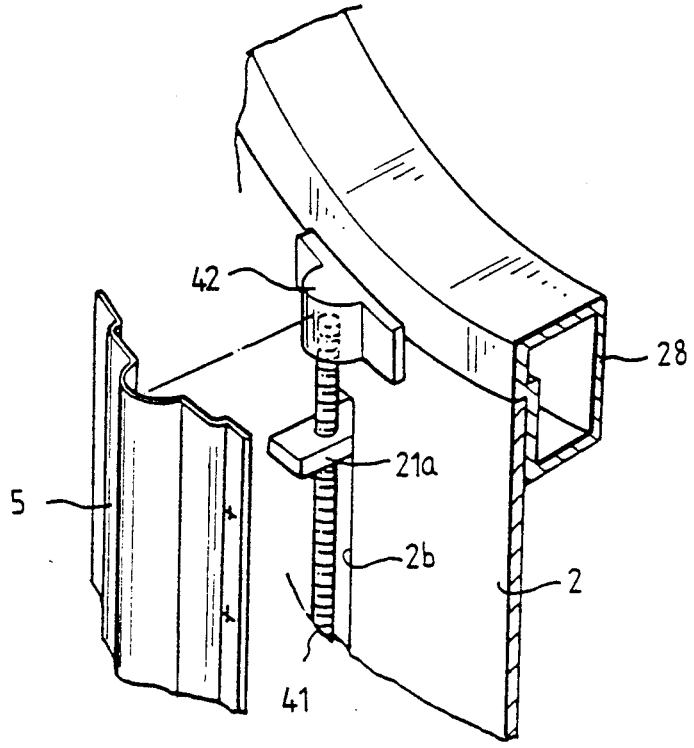

Turning next to FIG. 10 which is a side perspective view of the washing tub 2, the washing tub 2 has a vertically formed guide slot **2*b* provided to the side wall thereof, which guide slot 2*b* receives a protruding end of the annular guide portion 21 in order to guide the upward and downward movement of the guide portion 21, and a reinforcing plate 5 fixed to the side wall of the washing tub 2 in order to cover the feed screw 41 and adapted for reinforcing the side wall of the washing tub 2 which may be weakened by forming the guide slot 2*b***.

In the drawing, the reference numerals 4, 6 and 7 denote a drain hose, a water supplying valve and a drain valve, respectively.

Figure 11:
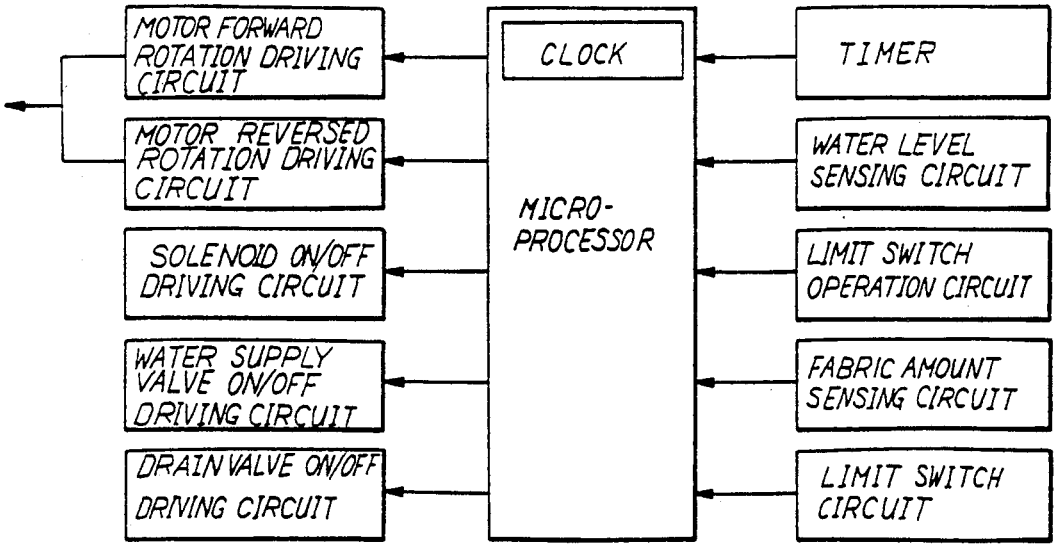
Figure 12A:
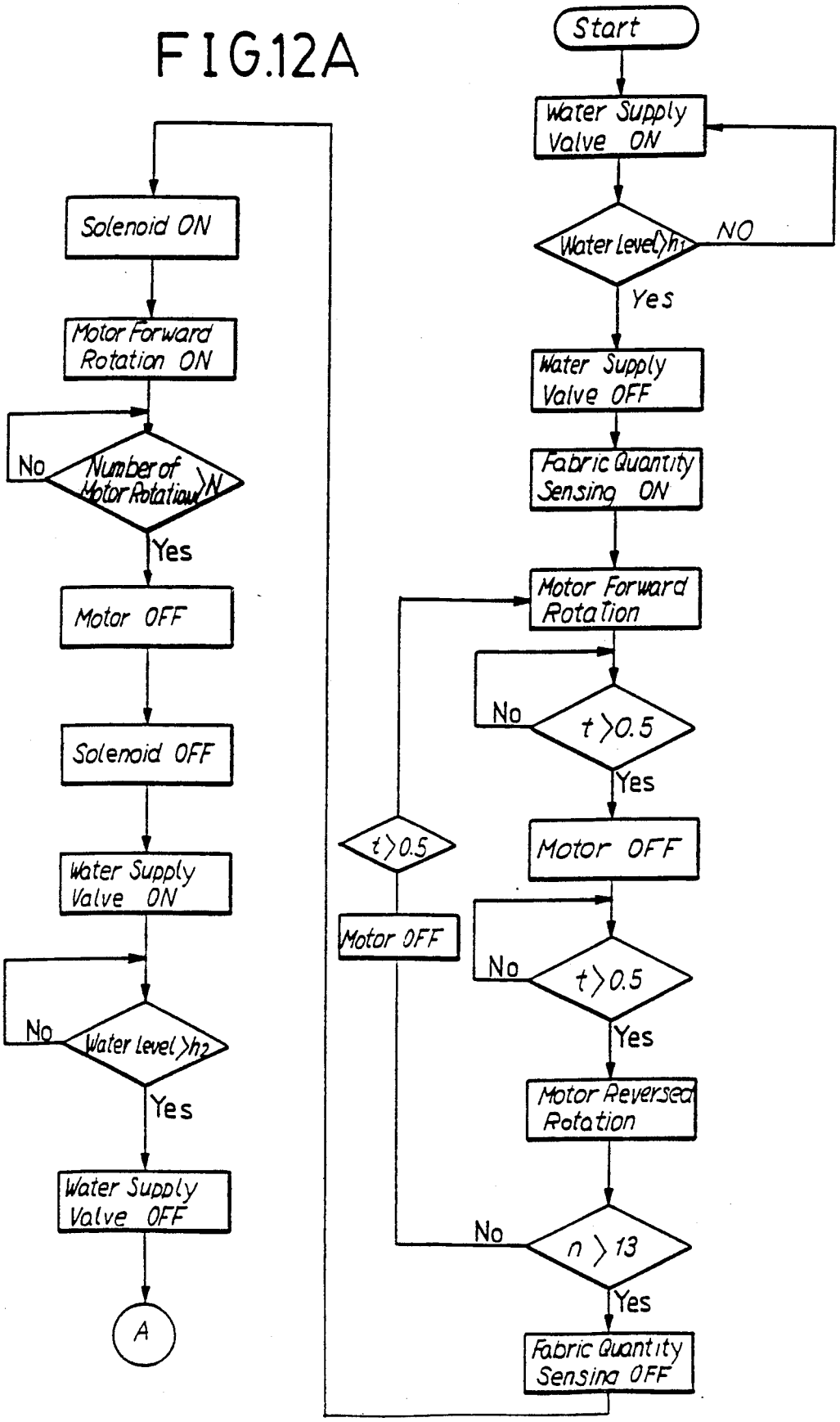
FIGS. 12A to 12C are continuous flow diagrams of operations performed by a microcomputer of the washing machine shown in FIG. 9.
Figure 12B:
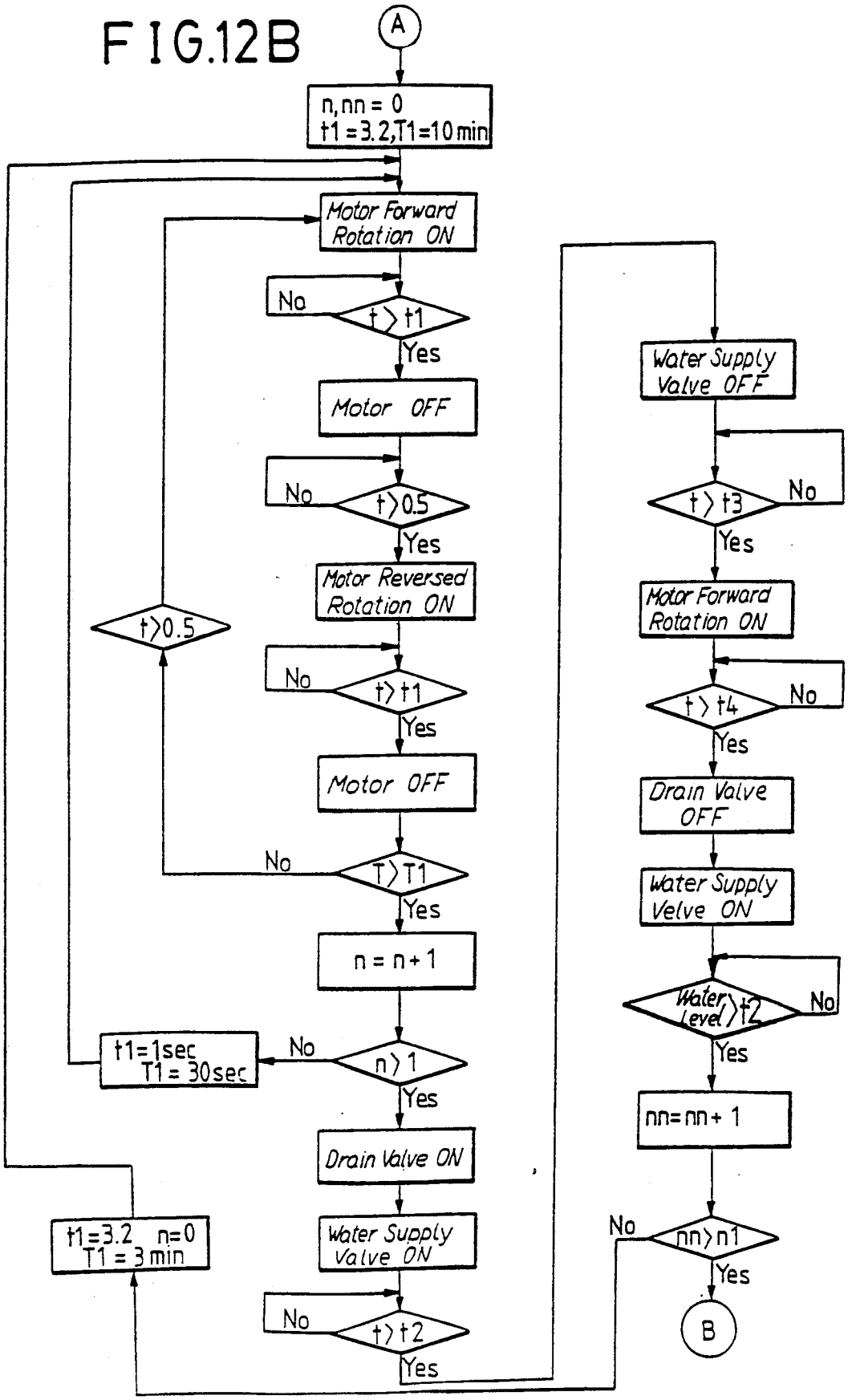
Figure 12C:
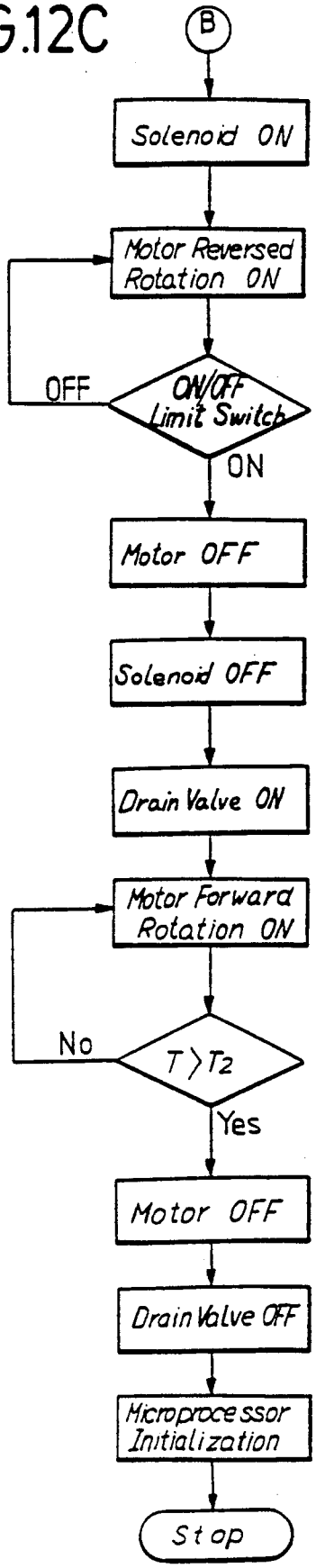

FIG. 11 is a control block diagram of the washing machine of FIG. 9, and FIGS. 12A to 12C are continuous flow diagrams of operations performed by a microcomputer of the washing machine shown in FIG. 9. In addition, the parameters shown in FIGS. 12 will be described as follows;

- h1: reference water level,
- h2: optimal water level in response to the sensed fabric quantity,
- t: respective times of steps,
- T: total time counted from the loop start,
- t1: alternative period of forward and reversed directional rotation during the washing and the rinsing out,
- t2: washing water supplying time,
- t3: washing water draining time,
- t4: dehydrating time during the rinsing out,
- T1: total time of the washing and the rinsing out operations,
- T2: total dehydrating time during the dehydration,
- N: the total number of the intermittent contacts of the permanent magnet with the coil in sensing the fabric quantity (the number of rotations of the driving motor x the number of magnets),
- n, nn: the number of repeats of the operations,
- n1: the repeating number of the rinsing out operations.

On the other hand, the pressure and rotary type washing machine in accordance with this invention is automatically controlled by a microprocessor of which the controlling process will be executed as described hereinafter in conjunction with FIGS. 9 to 12.

Upon switching on and selecting a desired washing course, simultaneously with sensing the water level by the water level sensor 74 the washing water supply valve 6 is turned on in order to supply the washing water into the washing tub 2, then turned off simultaneously with sensing the reference water level by the water level sensor 74 so that the washing water supplying operation may be cut off.

Upon accomplishing the washing water supplying, the driving motor 34 is periodically and alternately turned on and turned off in order to drive and stop the washing shaft 31 (for example, 13 times repeating of a period comprising a driving and a stopping each for 0.5 second), and simultaneously, the number of intermittent contacts of the permanent magnet 71 with the coil 72 of the fabric quantity sensor 70 is counted in order to open the water supply valve 6. The microprocessor, thereafter, compares the number of intermittent contacts counted by the fabric quantity sensor 70 with the reference data stored in RAM so that it can be determined whether the practical fabric quantity is larger than the reference quantity. Then, the microprocessor determines a position to which the annular guide portion 21 and the pressure plate 22 will move and the number of rotations of the washing shaft 31, and turns on the solenoid 61 of the lifting device 60.

Upon turning on the solenoid 61, the connecting lever 64 connecting with the plunger is biased downwards so as to drive the driving lever 63 to rotate counterclockwise centering around the lever shaft 63', in turn drive the power transmission 65 and the spacer 66 to be forced upwardly. Hence, the driving gear 51 moves upwardly against the tension power of the elastic body 67 in order to engage with the middle gear 52. Then, upon powering on the driving motor 34 so as to drive the washing shaft 31, the driving gear 51 rotates accompanying with the rotation of the washing shaft 31, thereby causing the middle gear 52, the driven gear 53 and the feed screw 41 to rotate, sequentially, resulting in inducing the downward movement of the annular guide portion 21 and the pressure plate 22. At this time, the fabric quantity sensor 70 continuously counts the number of rotations of the washing shaft 31 till the number of rotations reaches to the predetermined number of rotations at which the solenoid 61 is turned off. In result, the plunger of the lifting mechanism 60 moves upwardly so as to bias the connecting lever 64 upwardly, in turn drive the driving lever 63 to rotate clockwise, thereby causing the driving gear 51, the spacer 66, and the power transmission 65 to move downwardly by the restoring force of the elastic body 67, and the driving gear 51 to disengage from the middle gear 52. Hence, the middle and driven gears and the feed screwes 52, 53 and 41 stop rotating, respectively, in order to accomplish the locations of the annular guide portion 21 and the pressure plate 22 for washing operation. Also, upon sensing a washing water level corresponding to the quantity of the laundry articles by the water level sensor 74, the water supplying valve 6 is shut off, then the reversible motor 34 drives the agitating member 10 to repeat a washing period comprising a rotation in forward direction, stop rotating and rotation in reversed direction, for example, which washing period may comprise the forward rotation for 3.2 seconds, the stop of rotation for 0.5 second and the reversed rotation for 3.2 seconds.

If it is needed to repeat more than one time the above-mentioned washing period, the washing shaft 31 is driven to periodically and alternately rotate in forward and reversed direction for a predetermined short time, for example, which forward and reversed rotation may have one second period and executed for 30 seconds, thereby making it possible to prevent the laundry articles from heeling to one side.

After repeating the above-mentioned whole washing operations in a predetermined time, the water drain valve 7 is continuously opened and the water supply valve 6 is opened for a predetermined time in order to drain the bubbles generating during the washing operations, in turn, the water supply valve 6 is closed so that the washing water draining operation can be carried out for a predetermined time, for example, 20 to 30 seconds.

Thereafter, the reversible driving motor 34 is automatically turned on and off so as to intermittently drive the dehydrating shaft 32 to rotate and stop periodically four times in order to provide an intertia force for the dehydrating shaft 32, said rotate and stop period comprising a predetermined time period, such as one second period, and said intermittent rotations of the dehydrating shaft 32 comprising one directional rotations. Then, the dehydrating operation is carried out for a predetermined time, for example, 30 seconds. The water drain valve 7 is, thereafter, shut off and the water supply valve 7 is opened in order to supply the rinsing water into the washing tub 2 until reaching to an optimum amount of the rinsing water corresponding to the quantity of laundry articles, which optimum amount of the rinsing water will be sensed by the water level sensor 74 in order to shut off the water supply valve 6 and drive the driving motor 34. Upon sensing the optimum amount of the rinsing water, the washing shaft 31 is periodically driven so as to rotate intermittently, thereby rinsing the washed laundry articles for a predetermined rinsing time. A period of the intermittent rotation of the washing shaft 31 may comprise, for example, forward directional rotation for 3.2 seconds, stop for 0.2 second and reversed directional rotation for 3.2 seconds.

On the contrary, after the above-mentioned operations are repeated a predetermined times, the driving motor 34 stops rotating and the solenoid 61 is turned on and also the driving gear 51 fixed to the washing shaft 31 engages with the middle gear 52. Upon cooperating the driving gear 51 with the middle gear 52, the reversible driving motor 34 rotates in reversed direction so that the annular guide portion 21 and the pressure plate 22 may move upwards, respectively.

The upward movements of the pressure plate 22 and the annular guide portion 21 make the switch support 75 be biased upwards so that limit switch 76 may be turned on, in turn the driving motor 34 be turned off, resulting in stopping the annular guide portion 21 and the pressure plate 22 at their upper rest positions, then turning off the solenoid 61 of the lifting mechanism 60.

Thereafter, the water supply valve 7 and the reversible driving motor 34 are turned on, respectively, so that the dehydrating operation can be executed for a predetermined time. The driving motor 34 is then turned off, and thereafter, the drain valve 7 is closed when the pressure plate 22 is sensed to locate at the normal position by the pressure plate positional sensor so that the dehydrating shaft 32 can stop rotating by a braking action of a brake device in order to stop the rotation of the washing tub 2. Upon accomplishing the above-mentioned operations, the parameters of the microprocessor will be initialized.

As above-mentioned, the washing machine in accordance with the present invention can automatically control the washing, rinsing and dehydrating operations by the microprocessor, of which operations, the washing operation, the relatively important operation, will be more detailedly described as follows.

In washing operation, the annular guide portion 21 and the pressure plate 22 of the pressure member 20 move downwardly until contacting with the laundry articles C disposed on the agitating member 10 inside the washing tub 2, then stop the downward movement at the contacting position. Thereafter, upon rotation of the agitating member 10, the laundry articles C will be subject to the washing operation simultaneously with being agitated by the agitating member 10 inside a limited washing space S provided by the side walls of the washing tub 2, the agitating member 10 and the lower positioned pressure member 20. At this time, the pressure plate 22 has a prominent and depressed under surface 22' provided with a plurality of depressions and protrusions **22*a* and 22*b* which can provide a considerably strong pressing power for the laundry articles C which are also agitated by the agitating member 20 and scrubbed by the prominent and depressed under surface 22' of the pressure plate 22. Additionally, the rotatable circular plate 11 of the agitating member 10 is provided with the rollers 14 rotatably and radially mounted and capable of rotating cooperated with rotation of said agitating member 10, thereby causing the laundry articles C located between the pressure plate 22 and the rotatable circular plate 11 to be subject to the composite washing operation comprising the gentle hand washing, beating, scrubbing and agitating and rolling operations each provided by the prominent and depressed under surface 22' of the pressure plate 22 and the rollers 14 of the rotatable circular plate 11**.

Therefore, it is well known that the washing machine according to this invention can provide a considerably ameliorated washing efficiency for the laundry articles, which ameliorated washing efficiency can be provided by the above-mentioned composite washing operations comprising the gentle hand washing, beating, scrubbing and agitating and rolling operations each provided by the prominent and depressed under surface 22' of the pressure plate 22 and the rollers 14 of the rotatable circular plate 11. Furthermore, this washing machine can be provided with an optimum washing space S easily controlled in accordance with the quantity of the laundry articles so that the amount used of the washing water can be reduced.

In addition, this washing machine is provided with the reversible driving motor 34 by which simultaneously with selectively driving the annular guide portion 21 and the pressure plate 22 of the pressure member 20 to be efficiently reciprocated upwards and downwards by intermittent power transmission executed by the lifting mechanism 60 and the washing shaft 31 is driven so that there may be advantages of simple power supply and power economy.

Furthermore, the uppermost position of the pressure plate 22 of the pressure member 20 is regularly controlled by the limit switch 76 so that the laundry articles C may be easily put in and took out and also the safety accident during the washing and dehydrating operations can be prevented.

Figure 13:
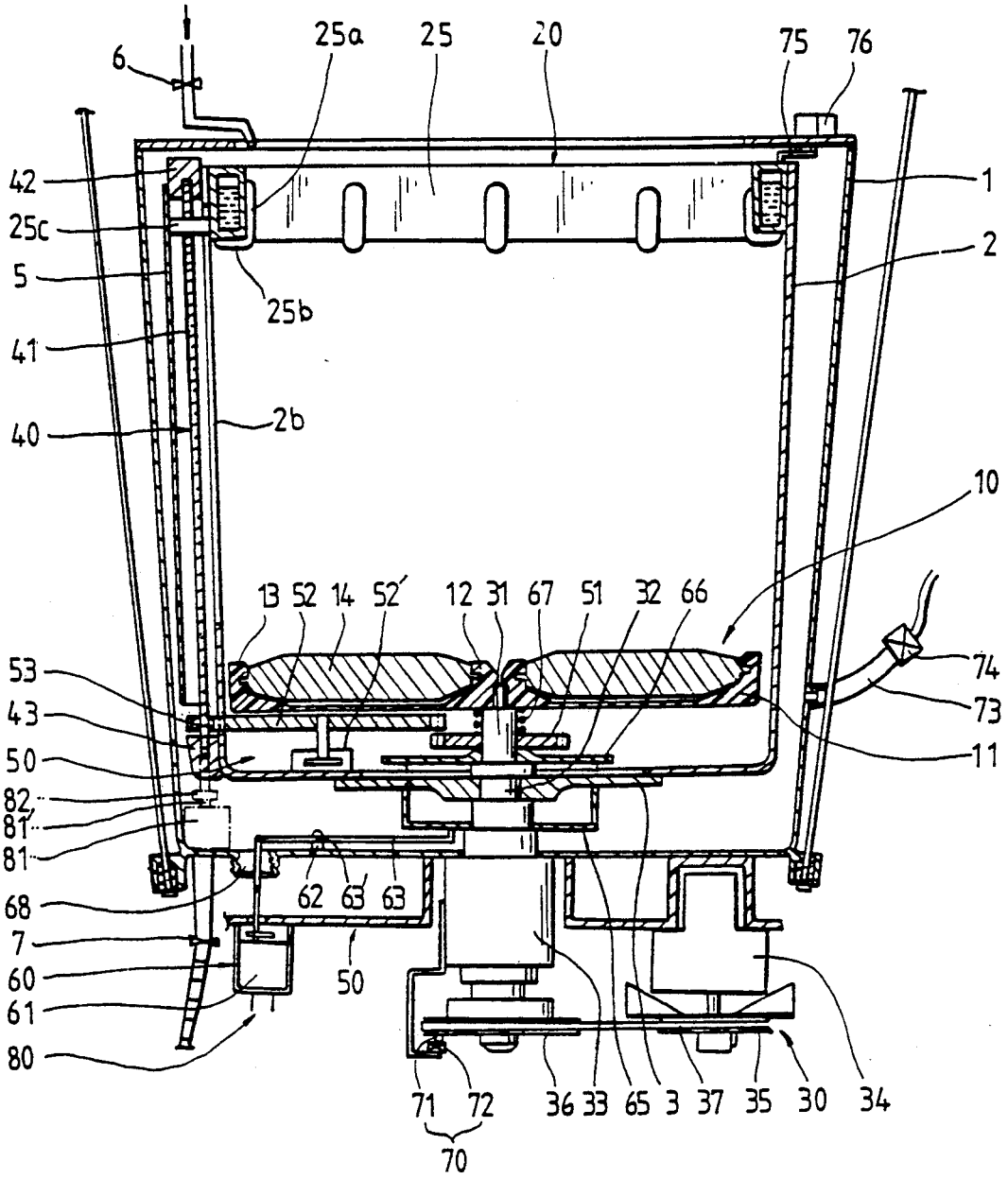
FIG. 13 is a view corresponding to FIG. 9, but showing another embodiment of a pressure and rotary type washing machine in accordance with the present invention.
Figure 14:
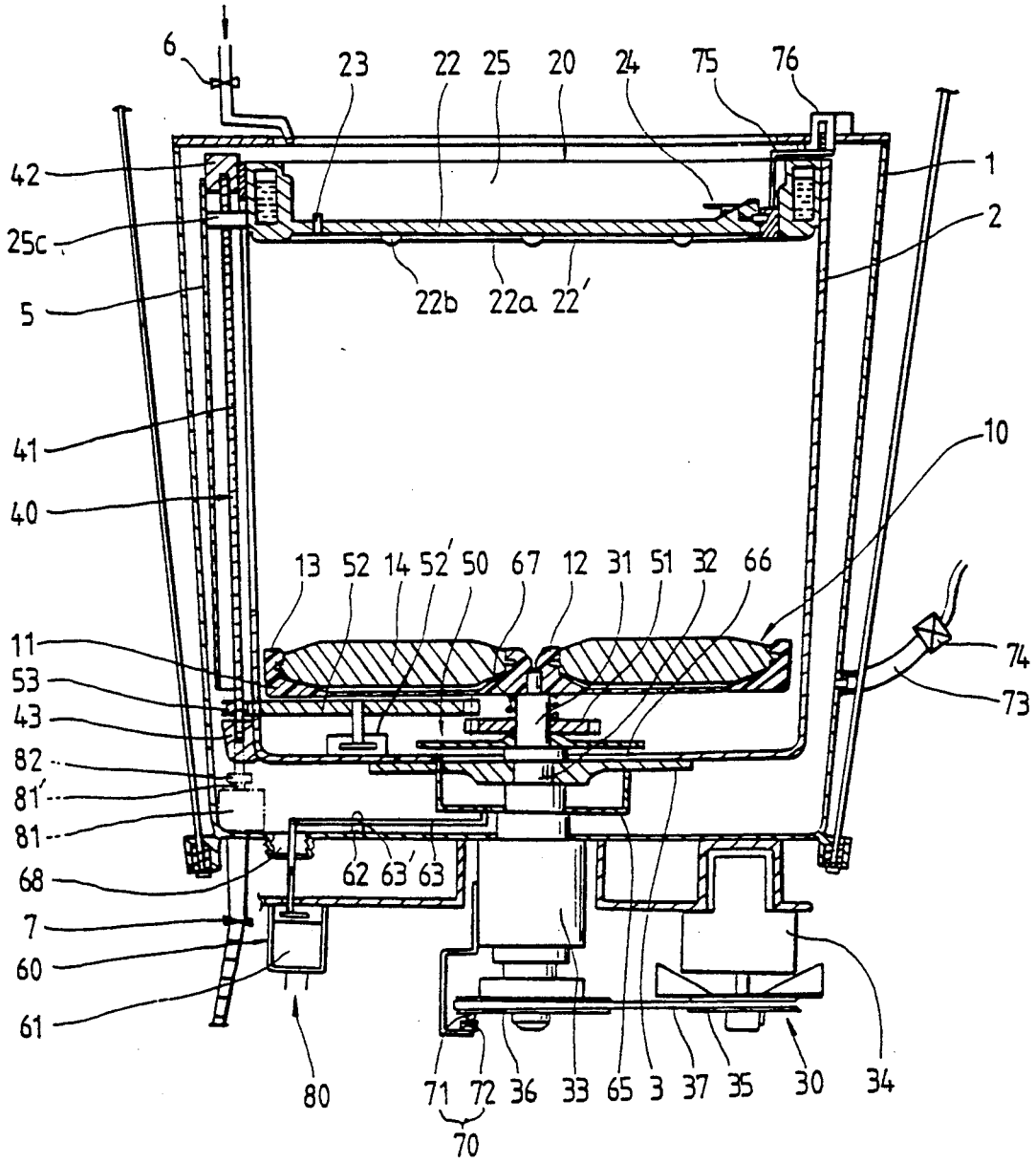
FIG. 14 is a view corresponding to FIG. 9, but showing still another embodiment of a pressure and rotary type washing machine in accordance with the present invention.

Turning next to FIGS. 13 and 14 which are elevational sectionedal views showing two another embodiments of a pressure and rotary type washing machine in accordance with the present invention, respectively, these washing machines each is provided with another type of pressure member 20 comprising a pressing combined used auto-balancer 25.

As shown in FIG. 13, the auto-balancer 25 is provided with a sidewardly extending protrusion **25*c* and a plurality of two types of projections 25*a* and 25*b*, said protrusion 25*c* having a threaded hole and said projections 25*a* and 25*b* provided at an inner periphery and under surface thereof, respectively. The two types of projections 25*a* and 25*b*** may be formed integrally with or separately from each other and also be provided as separately formed and crossing with each other, and furthermore, be provided any one type of them or all of two types.

Referring to FIG. 14, another type of a combined used auto-balancer 25 is at inner portion thereof provided with a pressure plate 22 of which an end is connected to said auto-balancer 25 by means of a hinge 23 in order to be openable and the other diametrically opposite end includes a locking device 24, which pressure plate 22 has a prominent and depressed under surface 22' provided with a plurality of depressions and protrusions **22*a* and 22*b***.

The pressure member driving mechanism 40, as shown in FIGS. 13 and 14, comprises a feed screw 41 which is vertically installed at a side of the washing tub 2 and having top and lower ends engaging with upper and lower bearings 42 and 43, respectively, and an upper portion engaging, in the screw type, with a protruding end **25*c* of the auto-balancer 25. There is provided, in the pressure member driving mechanism 40, a feed screw driving member 80 adapted for driving said feed screw 41**.

In addition, the feed screw driving member 80 may be, for an embodiment, provided with the driving motor 34 of the rotation driving device 30 and a power transmission device 50 for selectively transmitting the rotation power from the rotation driving device 30 to the feed screw 41, which embodiment of the feed screw driving member 80 is the same with the embodiment as shown in FIG. 9.

On the other hand, the feed screw driving member 80 may be, for another embodiment, provided with a separate and exclusive driving motor 81 fixedly disposed inside the outer imperforate tub 1, which separate driving motor 81 can provide advantages of a simple structure in which the power transmission device 50 may be removed and the lowermost end of the feed screw 41 extends downwardly in order to connecting with said separate driving motor 81 by means of a coupling 82, thereby driving the feed screw 41.

As above-mentioned, the first embodiment of feed screw driving member 80 provides an advantage of the combined use of the driving motor 34 for driving the washing and dehydrating shafts 31 and 32 even though there is also a drawback of necessity of separate power transmission device 50. On the contrary, the second embodiment thereof can provide an advantage of removing the separate power transmission device 50 even though there is also a drawback of necessity of separate and exclusive driving motor 81.

On the other hand, there is also provided the fabric quantity sensor 70 disposed under the clutch 33 and adapted for sensing the fabric quantity (the quantity of the laundry articles) and the water level sensor 74 adapted for sensing the water level and mounted at the washing water supplying pipe 73 extending outwardly from the relatively lower side portion of the outer tub 1. In addition, disposed on the upper portion of the washing tub 2 is a limit switch 76 having the limit switch support 75 which are cooperatively check the uppermost rising limit of the auto-balancer 25.

The structure and operation of the fabric quantity sensor 70 are similar to those of the embodiment shown in FIG. 9, therefore, can be referred to the previous description for the embodiment.

The water level sensor 74 adopts a sensing method which uses the natural frequencies of the coil and the resistance for sensing the water level, such that upon rising of the water level, a core wound by the coil will be retracted backwardly inside the coil by the rising water pressure, in turn, said water level sensor 74 counts the number of zero crossings of voltage outputted from the circuit oscillating at a natural frequency in accordance with the inductance and resistance, thereby sensing the water level.

In the drawings, the same elements as those of the embodiment shown in FIG. 9 are designated as the same reference numerals.

In comparison with the first embodiment of FIGS. 9 to 12, the operations of another embodiment shown in FIGS. 13 and 14 are discriminated by each applying with the combined used auto-balancer 25 which is driven by the pressure member driving mechanism 40 in order to substitute for annular guide portion 21 and the pressure plate 22 of said first embodiment, while the other operations are the same as those of said first embodiment.

Figure 15:
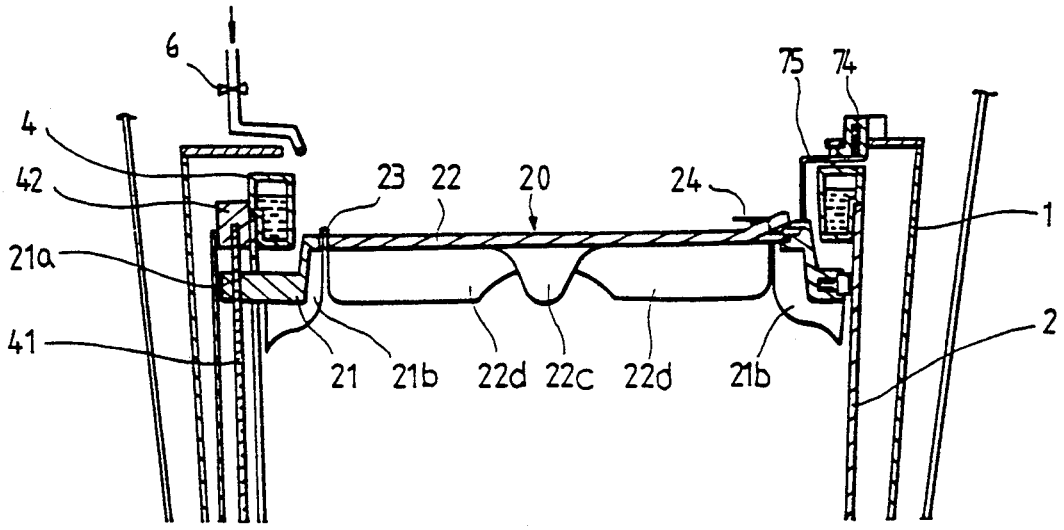
FIG. 15 is a sectional view showing another embodiment of a pressure member in accordance with the present invention.

In other words, each washing machine of FIGS. 13 and 14 is so driven that the auto-balancer 25 moves downwardly to be located at a position corresponding to the quantity of the laundry articles C in the washing tub 2, at which located position of the auto-balancer 25, the balancer 25 will contact with the laundry articles C. Thereafter, upon rotation of the agitating member 10, the laundry articles C will be subject to the composite washing operations inside the limited washing space S provided by the inner side surfaces of the washing tub 2, the auto-balancer 25 and the agitating member 10 so that the articles C may be washed to obtain the same washing effect as that of the first embodiment Turning next to FIG. 15 which is a sectional view showing another embodiment of a pressure member 20 in accordance with the present invention, the pressure member 20 comprises an annular guide portion 21 and a pressure plate 22 mounted to said guide portion 21 at an end thereof by means of a hinge 23 in order to be openable, said guide portion 21 provided with a plurality of first pressure protrusions **21*b* each having predetermined height and width and said pressure plate 22 provided with a center pressing protrusion 22*c* and a plurality of second pressure protrusions 22*d* formed centering around said center protrusion 22*c*** and radially formed and spaced apart from one another, thereby causing the washability to be considerably increased.

Turning again the washing machine shown in FIG. 14 in order to compare with this type of washing machine in operational effect, the washing machine of FIG. 14 may have a disadvantage encountered in comprising the pressure plate 22 of which one end is openably connected to the guide portion 21 by means of the hinge 23 and also the other end is provided with the locking device 24, thereby causing a main door of the washing machine and said pressure plate 22 to be obliged to be handled separately in order to be opened and closed.

Figure 16:
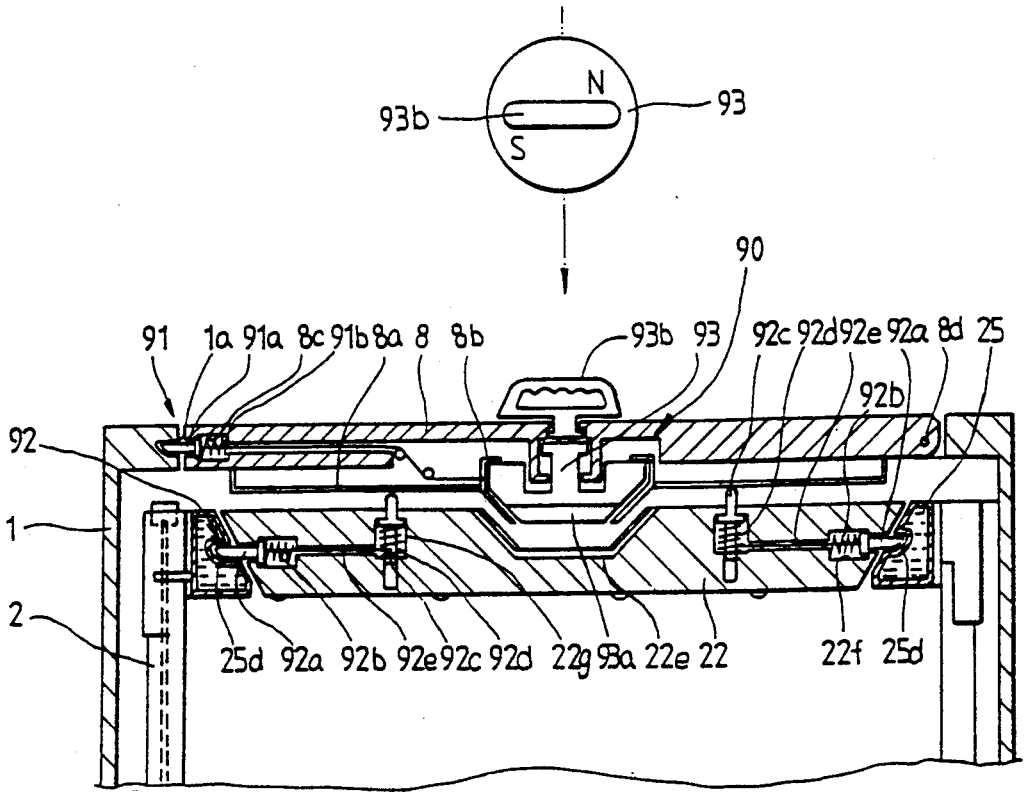
FIG. 16 is a sectional view showing a door and an open and close device for opening and closing a pressure member in accordance with the present invention.

In accordance, still another embodiment of a washing machine according to this invention may be so constructed as shown in FIG. 16 that a combined used opening device 90 is provided on the main door 8 of the washing machine in order to simultaneously handle said main door 8 and the pressure plate 22. This type of washing machine is provided with a washing tub 2 installed inside the outer tub 1 and including the main door 8 openably mounted at the uppermost portion by means of a hinge **8*d*, and a pressing combined used auto-balancer 25 installed inside said washing tub 2 to be capable of being reciprocated upwards and downwards and having a pressure plate 22**.

Additionally, the main door 8 includes at the center portion a rotary member 93 rotatably mounted thereto and provided with a magnet 93*a* and a knob 93*b* fixedly secured at the lower and upper ends thereof, respectively. Also, there is provided other magnet 22*e* mounted at the center of the pressure plate 22.

The respective magnets 93*a* and 22*e* of the rotary member 93 and the pressure plate 22 is so arranged that the N poles and the S poles thereof may be alternately disposed with each other. Hence, upon rotating the knob 93*b* in the locking direction (ON direction), the magnets 93*b* and 22*e* push with each other in order to be separated, on the contrary, upon rotating the knob 93*b* in the unlocking direction (OFF direction), they pull with each other in order to be abutted.

Fixed under the main door 8 is a supporting plate 8*a* which is also provided at its center portion with a magnet supporter 8*b* surrounding the magnet 93*a* of said rotary member 93 and adapted for supporting the rotation thereof.

The main door 8 is openably mounted to the outer tub 1 by means of a first locking device 91, and the pressure plate 22 is openably mounted to the auto-balancer 25 by means of a second locking device 92.

As shown in FIG. 16, the first locking device 91 comprises a locking slot 1*a* formed at the upper portion of the outer tub 1, a lock bolt enclosing slot 8*c* formed at an end of said main door 8, a lock bolt 91*a* enclosed in said enclosing slot 8*c*, a compression spring 91*b* provided at rear portion of said lock bolt 91*a* inside said enclosing slot 8*c* and adapted for biasing said lock bolt 91*a* outwardly and a tension string 91*c* connecting at an end thereof with the rear end of said lock bolt 91*a* and also connecting at the other end thereof with the rotary member 93.

The second locking device 92, on the other hand, comprises a pair of locking slots 25*d* formed at both diametrically opposite ends of the inner periphery of the auto-balancer 25, a pair of lock bolt enclosing slots 22*f* formed at both diametrically opposite outer ends of said pressure plate 22, a pair of lock bolts 92*a* each enclosed in each said enclosing slot 22*f*, a pair of compression springs 92*b* each provided at rear portion of each said lock bolt 92*a* inside said enclosing slot 22*f* and adapted for biasing each said lock bolt 92*a* outwardly, a pair of unlocking pins 92*c* enclosed in enclosing slots 22*g* each formed at inner portion of said pressure plate 22, a pair of compression springs each disposed in each said enclosing slot 22*g* for biasing said unlocking pin 92*c* upwardly and a pair of tension strings 92*e* each adapted connecting each said lock bolt 92*a* to each said unlocking pin 92*c*.

Therefore, the opening device 90 in accordance with this embodiment can generally operate in order to open the main door 8 by turning the knob 93*b* in the OFF direction so that the rotary member 93 may rotate, and the tension string 91*c* may in turn be tensed resulting in tensing the lock bolt 91*a* biased by the compression spring 91*b*, thereby causing said lock bolt 91*a* to be unlocked.

If more detailedly described, upon accomplishing the washing, rinsing and dehydrating operations, the auto-balancer 25 accompanying with the pressure plate 22 upwardly moves toward the upper portion of the washing tub 2 so that the unlocking pins 92*c* may be sufficiently pressed by contacting with the supporting plate 8*a* in order to be biased downwardly, resulting in tensing the tension strings 92*e* downwardly, in turn, pulling each lock bolt 92*a* against the biasing power of each compression spring 92*b* in order to be retracted out of the locking slot 25*d* of the auto-balancer 25, thereby making each said lock bolt 92*a* be free. Hence, the magnet 93*a* of said rotary member 93 can be attached to the magnet 22*e* of the pressure plate 22 by magnetic force so that the pressure plate 22 can be attached to the main door 8.

At this time, the reason of the attachment is magnetic force generating as the respective poles S and N of the magnets 22*e* and 93*a* face oppositely with each other.

The main door 8 can be, therefore, opened accompanying with the pressure plate 22.

On the other hand, upon turning the knob 93*b* in ON direction, the same poles of the magnets 22*e* and 93*a* face with each other, thereby causing the main door 8 and the pressure plate 22 to push from each other.

That is to say, as the knob 93*b* is driven to be turned in OFF direction, the locking states of the main door 8 and the pressure plate 22 will be changed into the unlocked state in which said door 8 and plate 22 are attached with each other by the magnetic force generating therebetween and can be opened and closed simultaneously as demands. On the contrary, as the knob 93*b* is driven to be turned in ON direction, the unlocked state of the door 8 and the plate 22 will be changed into the locked state at the same time.

It is, therefore, well known that the washing machine according to this invention can provide an advantage of easiness in practical usage as a result of the capability of opening and closing the main door 8 and the pressure plate 22 at the same time.

Turning next to FIGS. 17 to 20 which are views showing still another embodiment of a pressure and rotary type washing machine in accordance with this invention, this embodiment comprises an imperforate outer tub 1, an inner washing tub 2' disposed inside said outer tub 1, an agitating member 10 rotatably mounted on the bottom of said inner washing tub 2' and a pressure member 20 upward and downward movably mounted at the upper portion inside said washing tub 2'.

In this embodiment of the washing machine, the pressure member 20 is driven to move upwards and downwards by a pressure member driving mechanism 40 comprising a feed screw 41 and a power transmission device 50 for driving said feed screw 41, which feed screw 41 has uppermost and lowermost ends each supported by each screw bearing 44, and an upper portion engaging, in threaded type, with a radially outward extending end 21*a* of the pressure member guide portion 21.

The power transmission device 50 comprises a driven gear 53 rotatably mounted at the lower portion of the feed screw 41, a driving gear 54 rotatably mounted at the washing shaft 31, a middle gear 55 disposed between said driving and driven gears 54 and 53 in order to engage with said gears 53 and 54, thereby driving the feed screw 41 by the rotation power of said washing shaft 31 and in turn driving said pressure plate 22 to be reciprocated upwards and downwards, said middle gear 55 capable of moving upwards and downwards by a lifting mechanism 60.

The lifting mechanism 60 comprises a lifting pin 69*a* mounted on the bottom of the washing tub 2' at diametrically opposite portion to a shaft 55' of the middle gear 55, springs 69*b* each provided to said shaft 55' and lifting pin 69*a* and adapted for biasing them, sliders 69*c* each provided to said shaft 55′ and lifting pin 69*a*, a reel-shaped guider 69*d* mounted to the washing tub 2′ in order to move upwards and downwards and selectively engage with said sliders 69*c* and a solenoid 69 mounted under the bottom of said outer tub 1 and adapted for reciprocating said guider 69*d* upwardly and downwardly.

The pressure member 20 comprises an annular guide portion 21 and a pressure plate 26 provided with a pair of inner plates 26*a* and 26*b*.

The inner plates 26*a* and 26*b* are connected to each other by a plurality of hinges 26*c* in order to be folded, of which plates, one plate 26*a* connects with the guide portion 21 by means of a hinge 26*c*, while the other plate 26*b* has a handle 26*d* fixed thereon. There is provided a pair of springs 26*e* connecting the plates 26*a* and 26*b* with each other.

Figure 19:
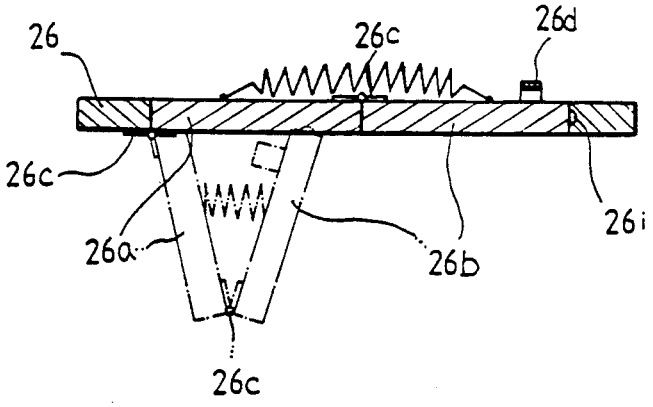

It is, therefore, possible to spread out as represented by solid line, and also fold the plates 26*a* and 26*b* as represented by dotted line in FIG. 19.

Figure 20:
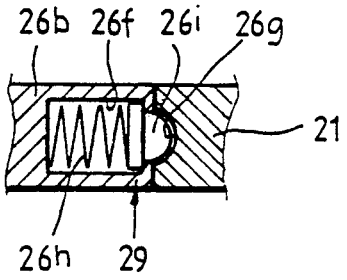

A locking device 29 is provide at an end of the pressure plate 26 and comprises, as shown in FIG. 20, a lock bolt enclosing slot 26*f* formed as depressed at the inner plate 26*b*, a lock bolt 26*i* received into said slot 26*f*, a compression spring 26*h* also received into the slot behind said lock bolt 26*i* in order to bias said bolt 26*i* outwardly and a locking slot 26*g* formed as depressed at the guide portion 21 in order to receive said lock bolt 26*i*.

In the drawings, FIGS. 17 to 20, the reference numeral 9 designates salt water contained in a side wall of the washing tub 2′ in order to provide a balance for said washing tub 2′, and the same numerals as those in FIG. 9 designate the same elements.

In operation of the washing machine of FIGS. 17 to 20, the washing water is supplied into the washing tub 2′ after folding the inner plates 26*a* and 26*b* of the pressure plate 26 by pressing the handle 26*d* of said plate 26 downwardly, and thereafter, the laundry articles are put in said washing tub 2′ and the handle 26*d* is pulled upwardly in order to spread out said plates 26*a* and 26*b* simultaneous with inserting the lock bolt 26*i* into the locking slot 26*g* of the guide portion 21, thereby accomplishing the locking operation.

The pressure plate 26 will, therefore, be a plane style plate in which the lock bolt 26*i* is forced to be maintained in the locking slot 26*g* by the biasing power of the compression spring 26*h* so that the plate 26 can endure the shocks given by the laundry articles in the washing space provided under said plate 26.

After putting the laundry articles in the washing tub 2′, the pressure plate 26 is located at an optimum height in accordance with the quantity of the laundry articles, which location for the pressure plate 26 will be more detailedly described hereinafter.

Figure 17:
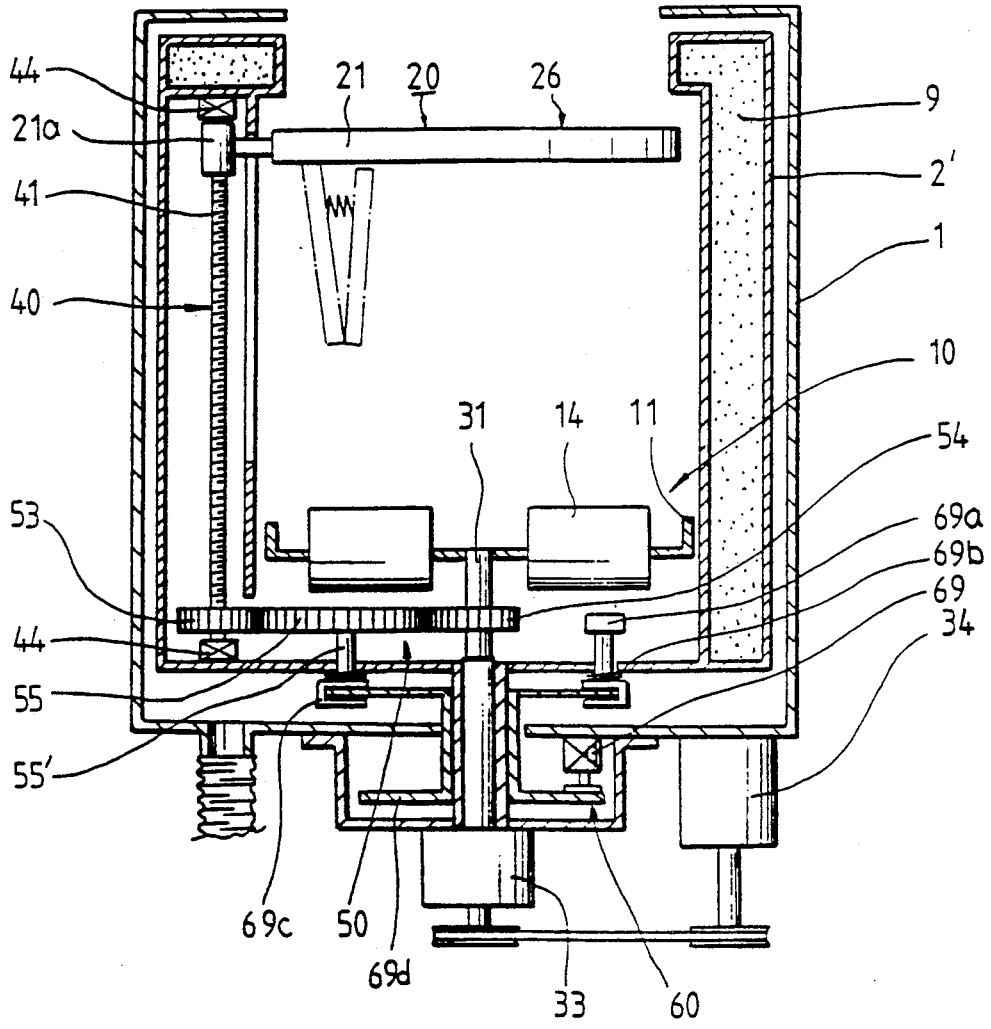
Figure 18:
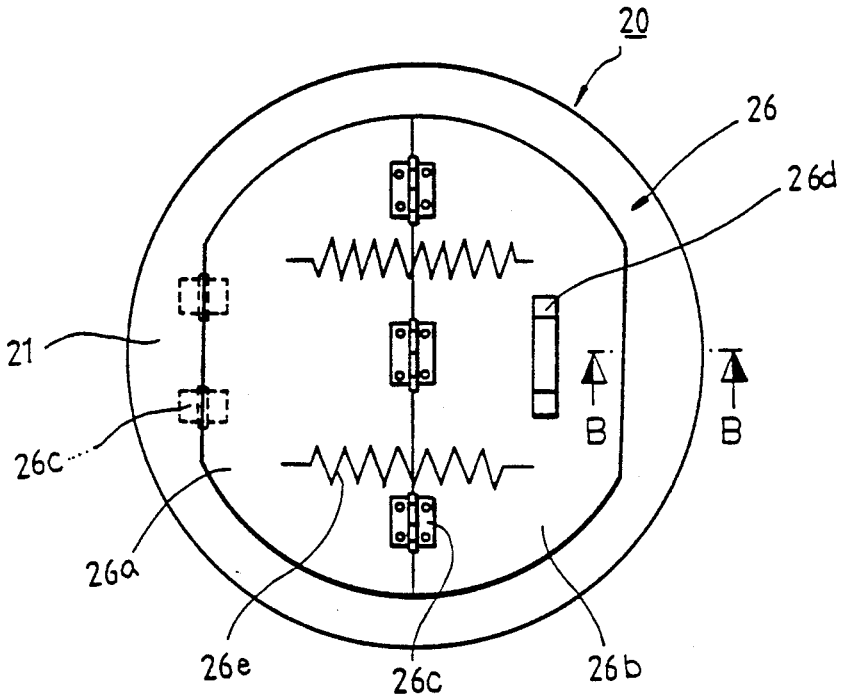

First, upon turning on the solenoid 69, the reel shaped guider 69*d* moves upwardly accompanying with upward movement of the slider 69*c* and the middle gear 55 each engaging therewith so that said middle gear 55 may engage with the driving and driven gears 54 and 53 as shown in FIG. 17. The washing shaft then rotates by the rotation power of the driving motor 34 in order to rotate the rotatable circular plate 11 simultaneous with the rotations of the driving, middle and driven gears 54, 55 and 53, thereby rotating the feed screw 41 resulting in causing the guide portion 21 connected thereto to move upwards or downwards depending on the rotational direction of said feed screw 41 and in turn the pressure plate 26 connecting with said guide portion 21 to move upwards and downwards at the same time. Hence, the pressure plate 26 can be located at the optimum position corresponding to the quantity of the laundry articles.

Second, after accomplishing the location of the pressure plate 26 in correspondence with the quantity of laundry articles, the solenoid 69 is turned off so that the springs 69*b* may bias downwardly the slider 69*c* and the middle gear 55 to return to their original positions. The middle gear 55, therefore, disengages from the driving and driven gears 54 and 53 resulting in shutting off the power transmission toward the feed screw 41, and in turn, stopping the movement of the pressure plate 26. Thus, the washing machine at this time washes the laundry articles only by the rotational power of the rotatable plate 11 driven by the rotation of the washing shaft 31.

As above-mentioned, this type of washing machine can provide an additional advantage of simple structure of the pressure member driving mechanism 40 beside providing the advantage of improved washability provided by the first and second embodiments of a washing machine shown in FIGS. 9 to 16.

Figure 21:
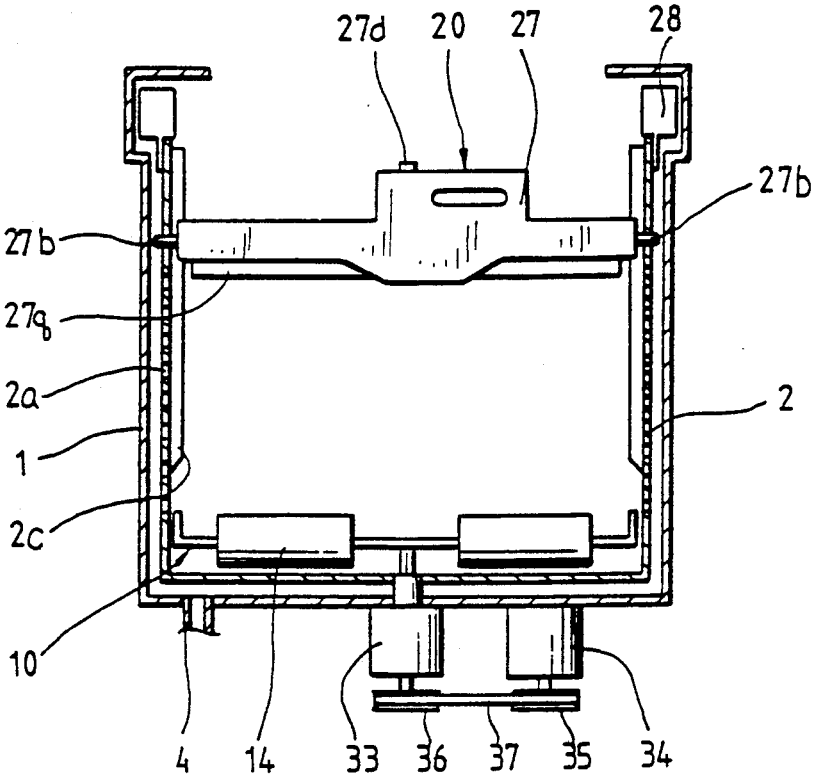
Figure 22:
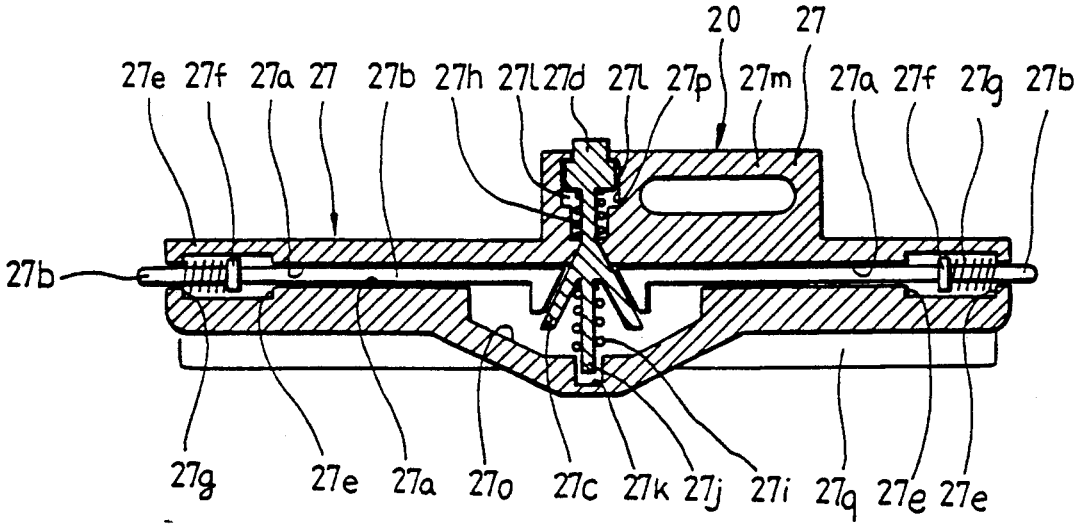
Figure 23:
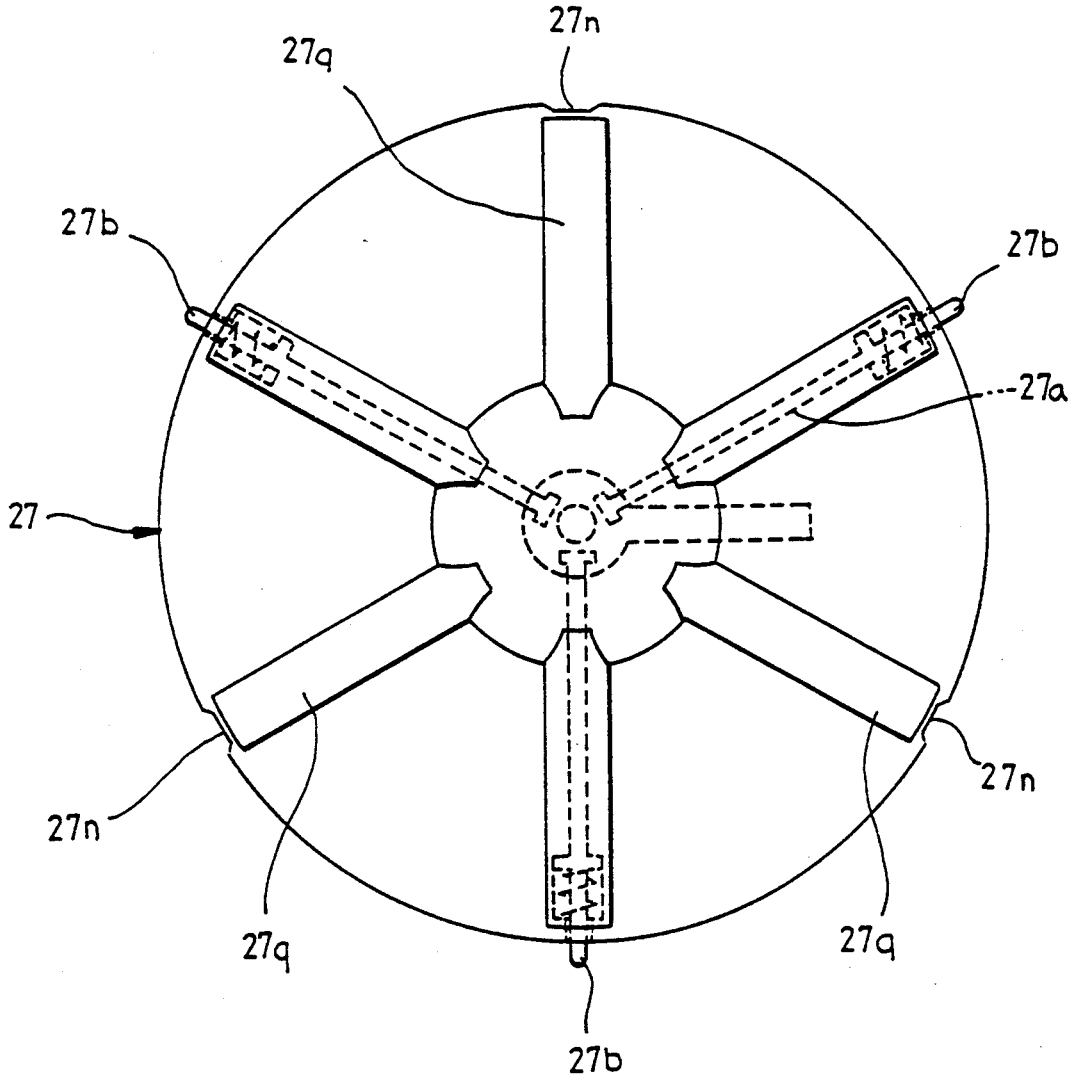

Turning next to FIGS. 21 to 23 which are views showing still another embodiment of a pressure and rotary type washing machine in accordance with the present invention, this embodiment includes a pressure member 20 provided inside the washing tub 2 in order to be manually controlled its location in accordance with the quantity of the laundry articles.

As shown in FIG. 21, the washing tub 2 is provided with a plurality of perforations 2*a* formed at the side wall thereof and also a plurality of vertically formed guide protrusions 2*c* provided in order to be spaced apart from one another on the inner surface of said side wall.

The pressure plate 20 is, as shown in FIGS. 21 to 23, provided with a pressure plate 27, a plurality of guide holes 27*a* radially formed and spaced apart from one another on said pressure plate 27, a plurality of lock bolts 27*b* each received into each said guide hole 27*a* in order to be capable of moving inwards and outwards by each springs, a truncated conical cap 27*c* and a push button 27*d* each mounted at the inner center of said pressure plate 27 and adapted for driving each said lock bolt 27*b*.

The pressure plate 27 is provided with a central cavity 27*o* therein, said plurality of guide holes 27*a* radially and outwardly formed centering said cavity 27*o* and spaced apart from one another, which guide holes 27*a* each is provided with forward and rearward steps 27*e* (see FIG. 22).

Enclosed inside each guide hole 27*a* is the lock bolt 27*b* which will be inserted into the perforations 2*a* of the washing tub 2 in order to locate the pressure plate 27 in accordance with the quantity of the laundry articles, said lock bolt 27*b* provided with a stopper 27*f* at outer portion thereof in order to limit the movement of said lock bolt 27*b*, and a compression coil spring 27*g* disposed onto said lock bolt 27*b* between said forward step 27*e* and said stopper 27*f* so as to bias said lock bolt 27*b* inwardly.

Also, there is provided, at the center portion of the plate 27 over the central cavity 27*o*, a vertically formed guide bore 27*p* communicating with said cavity 27*o* and having upper and lower steps 271, which guide bore receives the push button 27*d* in order to be protruded upwardly, said push button 27*d* biased by a compression coil spring 27*h*.

Directly below the push button 27*d* in the upper portion of the cavity 27*o*, the truncated conical cap 27*c* is vertically inserted in order to contact at its side surface with the respective inner ends of the lock bolts 27*b*, which conical cap 27*c* has a support stem 27*j* which is formed integrally therewith and downwardly therefrom and inserted into a guide slot 27*k* formed as depressed at the bottom center of said cavity 27, and usually biased upwards by a compression coil spring 27*i* provided thereonto.

In addition, a handle 27*m* is provided on the upper surface of the pressure plate 27, and a plurality of guide slots 27*n* are formed at periphery of the pressure plate 27, and spaced apart from one another and also each adapted for engaging with each vertically formed guide protrusions 2*c* provided on the inner surface of the washing tube 2.

The operation of this type of washing machine will be described as follows.

After putting in the laundry articles, adding the detergent and supplying the washing water into the washing tub 2, simultaneously with gripping the handle 27*m* of the pressure plate 27 the push button 27*d* is pushed downwardly in order to drive the truncated conical cap 27*c* to descend along the guide slot 27*k* against the restoring power of the coil spring 27*i* so that each lock bolt 27*b* may retracted inwardly by the restoring power of the compression coil spring 27*g*, thereby causing the outer end of lock bolt 27*b* to sank into the guide hole 27*a*.

As the push button 27*d* is pushed, the pressure plate 27 is displaced downwardly in order to make the guide slots 27*m* thereof each engage with each guide protrusion 2*c* of the washing tub 2, and thereafter, is forced to move downwardly to a predetermined depth, and the push button 27*d* is then free from pushing power upon aligning each entrance of the guide hole 27*a* with each perforation 2*a* of the washing tub 2 so that the conical cap 27*c* can be driven by the restoring power of the compression coil spring 27*i* to move upwardly resulting in pushing the lock bolt 27*b* outwardly, thereby causing the free end of the lock bolt 27*b* to be inserted into the perforation 2*a* of the washing tub 2 in order to accomplish the desired location of the pressure plate 27 corresponding to the quantity of the laundry articles. At this time, the height at which the pressure plate 27 is located is desired to be selected at a height capable of slightly pressing the laundry articles.

On the other hand, as the pressure plate 27 is secured at a position, ordinary washing operations start by rotation of the reversible driving motor 34 of which rotational power may be transmitted to rotatable circular plate 11 by the clutch 33 in order to drive said plate 11 to rotate. Therefore, the laundry articles will be subject to the rotation provided by the rollers 14 simultaneously with the pressure provided by the washing protrusions 27*q* of the pressure plate 27, thereby causing the washing machine to provide the washing effect comprising scrubbing action generating from the rolling and the friction provided by the agitating and pressure members 10 and 20 for the laundry articles disposed in the washing space S. Also, the dehydrating operation may be executed by rotations, at a high rotational speed, of the washing tub 2, the pressure plate 27 fixed to said washing tub 2 and the rotatable circular plate 11 in order to dry the washed and rinsed laundry articles by the centrifugal force generating as the washing tub 2 rotates.

As described above, the present invention can provide a pressure and rotary type washing machine including a pressure member having a plurality of washing protrusions and mounted inside the washing tub in order to be capable of being reciprocated, and an agitating member having rollers and mounted on the bottom of the washing tub, thereby making it possible to provide several advantages of an improved washing efficiency, an ameliorated washability, reducing the amount used of washing water and washing time, and furthermore, capability of large capacity washing.

Although the preferred embodiments of the present invention have been disclosed for illustrative purpose, those skilled in the art will appreciate that various modifications, additions and substitutions are possible, without departing from the scope and spirit of the invention as disclosed in the accompanying claims.

What is claimed is:

1. A pressure and rotary type washing machine having an imperforate outer tub and a perforated washing tub, said washing machine comprising:

agitating means rotatably mounted at a bottom of said washing tub and provided with at least one roller;

pressure means mounted movably upward and downward at an upper portion inside said washing tub and adapted for providing pressure for laundry articles;

rotation driving means adapted for selectively driving said washing tub or said agitating means; and pressure driving means adapted for driving said pressure means to move between a rest position and a washing position thereof.

2. A washing machine as claimed in claim 1, wherein said agitating means is provided with a rotatable circular plate and a plurality of rollers, said rollers radially and rotatably mounted between a center portion and a circumferential flange of said rotatable circular plate.

3. A washing machine as claimed in claim 1, wherein said pressure means comprises annular guide means and a circular pressure plate, said circular pressure plate connected at an end thereof to said annular guide means by hinge means.

4. A washing machine as claimed in claim 3, wherein said pressure plate has a prominent and depressed under surface provided with a plurality of depressions and protrusions.

5. A washing machine as claimed in claim 3, wherein said pressure plate comprises an annular guide portion and a pressure plate, said annular guide portion provided with a plurality of first pressure protrusions, and said pressure plate provided with a center pressing protrusion and a plurality of second pressure protrusions formed centering around said center protrusion and radially formed and spaced apart from one another.

6. A washing machine as claimed in claim 3, wherein said pressure member driving means comprises a feed screw and feed screw driving means adapted for driving said feed screw, said feed screw vertically installed at a side of said washing tub and having top and lower ends engaging with upper and lower bearings, respectively, and an upper portion engaging, in the screw type, with a protruding end of said annular guide means or said auto-balancer, said pressure means driven by a driving power of a driving motor.

7. A washing machine as claimed in claim 6, wherein said feed screw driving means transmits the power of a driving motor of said rotation driving means to said feed screw by means of power transmitting means.

8. A washing machine as claimed in claim 7, wherein said power transmitting means comprises a driven gear rotatably mounted at a lower portion of said feed screw, a middle gear mounted on a vertical shaft secured on the bottom of said outer tub and adapted for engaging with said driven gear, a driving gear rotatably mounted at said washing shaft of said clutch in order to selectively engage with said middle gear, said driving gear capable of moving upwards and downwards by lifting means.

9. A washing machine as claimed in claim 8, wherein said lifting means comprises a solenoid fixed under said outer tub, a driving lever disposed on a supporting portion of said outer tub by means of a lever shaft, a connecting lever for connecting said driving lever and a plunger of said solenoid, a power transmission movably mounted to a dehydrating shaft of said clutch so as to move upward and downward and cooperating with said driving lever, a spacer movably mounted to said washing shaft between said driving gear and said power transmission so as to be lifted by said power transmission in order to bias said driving gear upwardly as demands, and an elastic body for elastically supporting said driving gear, said spacer and said power transmission.

10. A washing machine as claimed in claim 7, wherein said power transmitting means comprises a driven gear rotatably mounted at a lower portion of said feed screw, a driving gear rotatably mounted at said washing shaft of said clutch, a middle gear disposed between said driving and driven gears in order to selectively engage with said gears, said middle gear capable of moving upwards and downwards by lifting means.

11. A washing machine as claimed in claim 10, wherein said lifting means comprises a lifting pin mounted on a bottom of said washing tub at diametrically opposite portion to a shaft of said middle gear, springs each provided to said shaft and lifting pin and adapted for biasing them, sliders each provided to said shaft and lifting pin, a reel-shaped guider mounted to said washing tub in order to move upwards and downwards and selectively engage with said sliders, and a solenoid mounted under a bottom of said outer tub and adapted for reciprocating said guider upwardly and downwardly.

12. A washing machine as claimed in claim 6, wherein said feed screw driving means comprises a driving motor connected to a lower end of said feed screw by means of a coupling.

13. A washing machine as claimed in claim 6, wherein said stirring tub is provided at the wall surface thereof a guide slot adapted for selectively engaging the guide mechanism or protrusions of the auto-balancer, and at the outer surface thereof a reinforcing plate adapted for covering the feed screw.

14. A washing machine as claimed in claim 6, wherein further comprises a limit switch provided with a limit switch supporter, said limit switch adapted for checking a rising limit of said annular guide means or said combined used auto-balancer.

15. A washing machine as claimed in claim 1, wherein said pressure means comprises a combined used auto-balancer, said auto-balancer mounted movably upward and downward at an upper portion inside said washing tub and adapted for providing pressure for laundry articles during washing operation and providing balance for said washing tub during dehydrating operation.

16. A washing machine as claimed in claim 15, wherein said combined used auto-balancer is provided with a sidewardly extending protrusion at an end and a plurality of two types of washing projections, said protrusion having a threaded hole and said projections provided at an inner periphery and under surface of said auto-balancer.

17. A washing machine as claimed in claim 15, wherein said combined used auto-balancer is provided with a pressure plate connected to an under surface thereof by hinge means and having a prominent and depressed under surface provided with a plurality of depressions and protrusions.

18. A washing machine as claimed in claim 1, wherein said pressure means comprises annular guide means, a pressure plate and locking means, said pressure plate provided with a pair of inner plates of which one is connected to said annular guide means by hinge means and the other is provided with a handle thereon, said locking means provided at an end of said other plate and adapted for locking said other plate to said annular guide means.

19. A washing machine as claimed in claim 1, wherein said pressure means comprises a pressure plate connected detachably to annular guide means or a combined used auto-balancer, and is opened, closed and locked, by an opening device, accompanying with a main door covering said imperforate outer tub.

20. A washing machine as claimed in claim 19, wherein said opening device comprises a rotary member rotatably mounted at a center portion of said main door and having a handle knob on the upper portion and a first magnet at the lower portion thereof, a second magnet mounted at a middle portion of said pressure plate and arranged so as to oppositely face the poles S and N thereof with poles of the first magnet, door locking means interlocking with said rotary member, and pressure plate locking means.

21. A washing machine as claimed in claim 20, wherein said door locking means comprises a locking slot formed at the upper portion of the outer tub, a lock bolt enclosing slot formed at an end of said main door, a lock bolt enclosed in said enclosing slot, a compression spring provided at rear portion of said lock bolt inside said enclosing slot and adapted for biasing said lock bolt outwardly and a tension string connecting at an end thereof with a rear end of said lock bolt and also connecting at the other end thereof with said rotary member.

22. A washing machine as claimed in claim 20, wherein said pressure plate locking means comprises a pair of locking slots formed at both diametrically opposite ends of an inner periphery of said combined used auto-balancer, a pair of lock bolt enclosing slots formed at both diametrically opposite outer ends of said pressure plate, a pair of lock bolts each enclosed in each said enclosing slot, a pair of compression springs each provided at rear portion of each said lock bolt inside said enclosing slot and adapted for biasing each said lock bolt outwardly, a pair of unlocking pins enclosed in enclosing slots each formed at inner portion of said pressure plate, a pair of compression springs each disposed in each said enclosing slot for biasing said unlocking pin upwardly and a pair of tension strings each adapted connecting each said lock bolt to each said unlocking pin.

23. A washing machine as claimed in claim 1, wherein said pressure means comprises a pressure plate, said pressure plate provided with a plurality of washing protrusions radially formed under surface thereof and spaced apart from one another, a plurality guide holes radially formed therein and spaced apart from one another, a plurality of lock bolts each received into each said guide hole in order to be capable of moving inwards and outwards by a compression coil spring, a truncated conical cap and a push button each mounted at a center cavity of said pressure plate and adapted for driving each said lock bolt.

24. A washing machine as claimed in claim 23, wherein said pressure plate of said pressure means is provided with a handle mounted thereon.

25. A washing machine as claimed in claim 23, wherein said pressure plate of said pressure means is provided with a plurality of guide slots each formed at periphery thereof and spaced apart from one another and also adapted for engaging with each vertically formed guide protrusions provided on said inner surface of said washing tub.

* * * * *